US011506375B2

(12) United States Patent
Huang et al.

(10) Patent No.: US 11,506,375 B2
(45) Date of Patent: Nov. 22, 2022

(54) LIGHTING MODULE AND LIGHTING DEVICE

(71) Applicant: HANGZHOU HPWINNER OPTO CORPORATION, Hangzhou (CN)

(72) Inventors: Jianming Huang, Hangzhou (CN); Kai Chen, Hangzhou (CN)

(73) Assignee: HANGZHOU HPWINNER OPTO CORPORATION, Hangzhou (CN)

( * ) Notice: Subject to any disclaimer, the term of this patent is extended or adjusted under 35 U.S.C. 154(b) by 0 days.

(21) Appl. No.: 17/337,523

(22) Filed: Jun. 3, 2021

(65) Prior Publication Data

US 2021/0356112 A1 Nov. 18, 2021

Related U.S. Application Data

(63) Continuation-in-part of application No. PCT/CN2020/099379, filed on Jun. 30, 2020.

(30) Foreign Application Priority Data

Aug. 14, 2019 (CN) ..... 201921314979.4
Dec. 19, 2019 (CN) ..... 201911318684.9
(Continued)

(51) Int. Cl.
*F21V 31/00* (2006.01)
*F21V 3/00* (2015.01)
(Continued)

(52) U.S. Cl.
CPC ..... *F21V 31/005* (2013.01); *F21V 3/00* (2013.01); *F21V 29/74* (2015.01); *F21Y 2115/10* (2016.08)

(58) Field of Classification Search
CPC ..... F21V 3/00; F21V 31/005; F21V 29/74
See application file for complete search history.

(56) References Cited

U.S. PATENT DOCUMENTS 9,518,724 B2 * 12/2016 Kwak ..... F21K 9/20
2012/0188766 A1 * 7/2012 Lu ..... F21V 17/005 362/249.02
(Continued)

FOREIGN PATENT DOCUMENTS

CN 101446392 A 6/2009
CN 104251390 A 12/2014
WO 2011137361 A1 11/2011

OTHER PUBLICATIONS

International Search Report in corresponding International Application No. PCT/CN2020/099379, dated Oct. 13, 2020.
(Continued)

*Primary Examiner* — Gerald J Sufleta, II
(74) *Attorney, Agent, or Firm* — Leason Ellis LLP

(57) ABSTRACT

A lighting module and a lighting device. The lighting module includes: a base, including a bottom plate and a base sidewall disposed on the bottom plate, the base sidewall and the bottom plate enclosing an accommodation groove; a light transmitting component, being partially disposed in the accommodation groove so as to form an accommodating space between the light transmitting component and the bottom plate, the light transmitting component including a light transmitting component sidewall which is oppositely arranged with the base sidewall at an interval; and a sealing component, being partially disposed between the light transmitting component sidewall and the base sidewall, and being in close contact with the light transmitting component sidewall and the base sidewalls respectively so as to seal the accommodating space.

17 Claims, 17 Drawing Sheets

(30) Foreign Application Priority Data

| | | |
|---|---|---|
| Dec. 19, 2019 | (CN) | 201922297295.4 |
| Dec. 19, 2019 | (CN) | 201922299275.0 |
| Jun. 3, 2020 | (CN) | 202020993657.3 |

(51) Int. Cl.
*F21V 29/74* (2015.01)
*F21Y 115/10* (2016.01)

(56) References Cited

U.S. PATENT DOCUMENTS

| | | | | |
|---|---|---|---|---|
| 2015/0260376 | A1* | 9/2015 | Joo | F21V 5/007 362/322 |
| 2016/0003454 | A1* | 1/2016 | Ye | F21V 29/89 362/268 |
| 2018/0017247 | A1* | 1/2018 | Van Asselt | H05K 1/056 |
| 2018/0045399 | A1* | 2/2018 | Chen | F21V 29/773 |

OTHER PUBLICATIONS

Extended European Search Report for the corresponding European Patent Application No. 20852694.7, dated Feb. 24, 2022. 6 Pages.

* cited by examiner

200

200

10

100

141

200

LIGHTING MODULE AND LIGHTING DEVICE

The present application is a continuation in part of international application PCT/CN2020/099379 filed on Jun. 30, 2020, which claims the priority of Chinese Patent Applications No. 201911318684.9, No. 201922299275.0 and No. 201922297295.4 filed on Dec. 19, 2019, and Chinese Patent Application No. 201921314979.4 filed on Aug. 14, 2019. This application also claims priority from Chinese Patent Application No. 202020993657.3 filed on Jun. 3, 2020, the disclosures of all these applications are incorporated herein by reference in its entirety as part of the present application.

TECHNICAL FIELD

Embodiments of the present disclosure relate to a lighting module and a lighting device.

BACKGROUND

With the continuous development of economy and the acceleration of urbanization, the market of lighting devices is growing. Generally, the lighting device may include one or more lighting modules, and the lighting modules may include a light emitting element, a heat sink and a lens component; the light emitting element is used for emitting light, the lens component is used for distributing light emitted by the light emitting element, and the heat sink is used for heat dissipation of the light emitting element.

Light emitting diode (LED) is a semiconductor light emitting element. Generally, the light emitting diode includes a semiconductor chip. By applying a current to the semiconductor chip, excess energy can be released through a recombination of carriers in the semiconductor to cause photon emission, so that the semiconductor chip can emit light.

SUMMARY

Embodiments of the present disclosure provide a lighting module, an assembly method thereof, and a lighting device. The lighting module includes a base, a light-transmitting component, and a sealing component. The base includes a bottom plate and a base sidewall arranged on the bottom plate, the base sidewall and the bottom plate enclosing an accommodating groove; the light-transmitting component is at least partially arranged in the accommodating groove to form an accommodating space between the light-transmitting component and the bottom plate, the light-transmitting component includes a light-transmitting component sidewall, and the light-transmitting component sidewall and the base sidewall are oppositely arranged at an interval; and the sealing component is at least partially arranged between the light-transmitting component sidewall and the base sidewall, and is in close contact with the light-transmitting component sidewall and the base sidewall, respectively, so as to seal the accommodating space. Therefore, the lighting module can increase the area of the accommodation space to set more light emitting elements, thereby improving the utilization rate of the light emitting surface of the lighting module, and improving the illumination brightness and luminous efficiency under the condition that the power of the lighting module is the same. In addition, the lighting module can also reduce the defective rate of products, save the installation steps, improve the installation efficiency and reduce the cost because there is no need to dispose a pressing frame, buckle or screw on the edge of the light-transmitting component.

At least one embodiment of the disclosure provides a lighting module including a base, including a bottom plate and a base sidewall arranged on the bottom plate, the base sidewall and the bottom plate enclosing an accommodating groove; a light-transmitting component, at least partially arranged in the accommodating groove to form an accommodating space between the light-transmitting component and the bottom plate, the light-transmitting component including a light-transmitting component sidewall, and the light-transmitting component sidewall and the base sidewall being oppositely arranged at an interval; and a sealing component, at least partially arranged between the light-transmitting component sidewall and the base sidewall, and being in close contact with the light-transmitting component sidewall and the base sidewall, respectively, so as to seal the accommodating space.

For example, in the lighting module according to an embodiment of the disclosure, Shore hardness of the sealing component ranges from 25 to 40.

For example, in the lighting module according to an embodiment of the disclosure, a compression ratio of the sealing component in a direction perpendicular to the base sidewall ranges from 15% to 22%.

For example, in the lighting module according to an embodiment of the disclosure, a compression amount of the sealing component in a direction perpendicular to the base sidewall ranges from 0.4 to 0.6 mm.

For example, in the lighting module according to an embodiment of the disclosure, the sealing component is a sealing ring.

For example, in the lighting module according to an embodiment of the disclosure, the base includes two base sidewalls extending along a first direction, the two base sidewalls are oppositely arranged and form the accommodating groove with the bottom plate, the sealing component is a sealing strip which is at least partially arranged between the light-transmitting component sidewall and the base sidewall which are correspondingly arranged, and the sealing strip is in close contact with the light-transmitting component sidewall and the base sidewall, respectively.

For example, the lighting module according to an embodiment of the disclosure further includes: a sealing structure, located between the light-transmitting component and the bottom plate and at least located at two ends of the two base sidewalls in the first direction, wherein the sealing structure and the sealing strip collectively seal the accommodating space.

For example, in the lighting module according to an embodiment of the disclosure, the two base sidewalls are not perpendicular to the bottom plate, so as to change a light emitting angle of the lighting module.

For example, in the lighting module according to an embodiment of the disclosure, the light-transmitting component further includes: an anti-glare structure located at positions where the two ends of the two base sidewalls in the first direction are located.

For example, the lighting module according to an embodiment of the disclosure further includes: a sealant, at least a part of which is located at an end of an interval between the light-transmitting component sidewall and the base sidewall, and the end is located at a side of the sealing component away from the bottom plate.

For example, in the lighting module according to an embodiment of the disclosure, the light-transmitting component sidewall is configured to apply a force, towards the base sidewall, to the sealing component, so that the sealing component is in a compressed state.

For example, in the lighting module according to an embodiment of the disclosure, the light-transmitting component sidewall includes: a first sidewall, oppositely arranged at an interval with the base sidewall and having a first interval with the base sidewall; and a second sidewall, oppositely arranged at an interval with the base sidewall and having a second interval with the base sidewall, wherein the first sidewall is located at a side of the second sidewall away from the base, the second interval is larger than the first interval, and the sealing component is at least partially arranged between the second sidewall and the base sidewall, and is in close contact with the second sidewall and the base sidewall, respectively.

For example, in the lighting module according to an embodiment of the disclosure, the sealing component includes a first sealing portion, the first sealing portion is arranged between the light-transmitting component sidewall and the base sidewall, and the first sealing portion upon being in an uncompressed state, includes: a first flat surface, configured to contact the second sidewall; a first arc surface, arranged opposite to the first flat surface, protruding outward and configured to contact with the base sidewall; and a first inclined surface, connected with the first arc surface and located at a side of the first arc surface close to the base, wherein the first inclined surface is configured to be spaced apart from the second sidewall to form a deformation space.

For example, in the lighting module according to an embodiment of the disclosure, the first arc surface is in close contact with the base sidewall and in a compressed state to form a contact surface; the first inclined surface is located between the first sidewall and the bottom plate; and an orthographic projection of the first inclined surface on the bottom plate at least partially overlaps with an orthographic projection of the second interval on the bottom plate.

For example, in the lighting module according to an embodiment of the disclosure, the sealing component further includes a second sealing portion, the second sealing portion is arranged between the light-transmitting component and the bottom plate and connected with the first sealing portion.

For example, the lighting module according to an embodiment of the disclosure further includes: a circuit board, located in the accommodating space; and at least one light emitting element, arranged on the circuit board and configured to emit light towards the light-transmitting component, wherein the light-transmitting component includes at least one lens portion, and the at least one lens portion is arranged in one-to-one correspondence with the at least one light emitting element.

For example, in the lighting module according to an embodiment of the disclosure, an interval is provided between an edge of the circuit board close to the base sidewall and the base sidewall, and the second sealing portion is arranged between the edge of the circuit board close to the base sidewall and the base sidewall.

For example, in the lighting module according to an embodiment of the disclosure, the light-transmitting component sidewall further includes: a third sidewall, arranged opposite to the base sidewall and having a third interval with the base sidewall, the third sidewall is located at a side of the second sidewall close to the bottom plate, and the third interval is smaller than the second interval, the first sidewall, the second sidewall and the third sidewall form a concave portion concaved towards a center of the light-transmitting component, and the sealing component is located in the concave portion.

For example, in the lighting module according to an embodiment of the disclosure, the light-transmitting component sidewall further includes: a fourth sidewall located at a side of the first sidewall away from the bottom plate, and the base sidewall includes a fifth sidewall, the fourth sidewall and the fifth sidewall are oppositely arranged with a fourth interval therebetween; the fourth interval is larger than the first interval, the fourth interval is communicated with the first interval and the second interval; the lighting module further includes a sealant, which is at least partially located in the fourth interval to seal the first interval and the second interval.

For example, in the lighting module according to an embodiment of the disclosure, the base sidewall includes a recessed portion, the recessed portion is recessed from a surface of the base sidewall close to the light-transmitting component sidewall, and configured to accommodate a part of the sealing component.

For example, in the lighting module according to an embodiment of the disclosure, the bottom plate includes a groove, an orthographic projection of the sealing component on the bottom plate at least partially overlaps with the groove.

For example, in the lighting module according to an embodiment of the disclosure, the light-transmitting component includes a first buckle located at a center of the light-transmitting component, and the base includes a second buckle located at a center of the base, and the first buckle and the second buckle are connected with each other.

For example, in the lighting module according to an embodiment of the disclosure, the light-transmitting component, the base and the accommodating space are provided with no screws.

An embodiment of the disclosure provides a lighting device, including: the lighting module according to any one of above items; and a heat sink, configured to dissipate heat for the lighting module.

For example, in the lighting device according to an embodiment of the disclosure, the heat sink includes: a heat sink plate, including a plurality of sub heat sink plates, the lighting device includes a plurality of lighting modules, and the lighting modules are arranged in one-to-one correspondence with the plurality of sub heat sink plates, and the base of each of the plurality of lighting modules is fixed on a corresponding one of the plurality of sub heat sink plates.

For example, in the lighting device according to an embodiment of the disclosure, the heat sink plate is an integrally formed single component.

For example, in the lighting device according to an embodiment of the disclosure, the base of each of the plurality of lighting modules is integrated with a corresponding one of the plurality of sub heat sink plates.

For example, in the lighting device according to an embodiment of the disclosure, lateral surfaces of two adjacent ones of the plurality of sub heat sink plates are connected.

For example, in the lighting device according to an embodiment of the disclosure, a plurality of heat sink fins are provided on a side of each of the plurality of sub heat sink plates away from the light-transmitting component.

For example, in the lighting device according to an embodiment of the disclosure, two adjacent ones of the plurality of sub heat sink plates are arranged at an interval, and are connected through the plurality of heat sink fins.

For example, in the lighting device according to an embodiment of the disclosure, each of the plurality of heat sink fins is provided with a plurality of heat sink notches.

For example, in the lighting device according to an embodiment of the disclosure, the heat sink plate and the plurality of heat sink fins are integrally formed by die casting.

For example, in the lighting device according to an embodiment of the disclosure, each of the plurality of sub heat sink plates includes two long edges and two short edges, and the two short edges are respectively provided with a fixing portion configured to be connected with an external lamp shell.

For example, in the lighting device according to an embodiment of the disclosure, each of the plurality of sub heat sink plates is provided with a wire passing hole.

For example, in the lighting device according to an embodiment of the disclosure, a sealing plug is arranged in the wire passing hole, the sealing plug passes through the wire passing hole and includes a through hole allowing a wire to pass through.

For example, the lighting device according to an embodiment of the disclosure further includes: a plurality of power wires, which are arranged in one-to-one correspondence with a plurality of wire passing holes, a first end of each of the plurality of power wires penetrates through a through hole of a corresponding sealing plug.

For example, in the lighting device according to an embodiment of the disclosure, a communication groove is provided on a side of the heat sink plate away from the light-transmitting component, the communication groove connects a plurality of wire passing holes of the plurality of sub heat sink plates, and second ends of the plurality of power wires are converged through the communication groove and have a lead-out end, the lighting device further includes a threaded pipe, which is fixed at the periphery of any one of the plurality of wire passing holes, and the lead-out end passes through the threaded pipe and is fastened by the threaded pipe.

For example, the lighting device according to an embodiment of the disclosure further includes: a sealing unit, the located in the communication groove and sealing the plurality of power wires in the communication groove.

An embodiment of the disclosure provides an assembly method of the lighting module according to any one of the above items, including: sleeving an outer side of the light-transmitting component sidewall with the sealing component; positioning the base and the light-transmitting component; applying a force, towards the base, to the light-transmitting component to allow the sealing component to be arranged between the light-transmitting component sidewall and the base sidewall to seal an interval between the light-transmitting component sidewall and the base sidewall.

For example, in the assembly method of the light emitting module according to an embodiment of the disclosure, in the case where the lens component sidewall includes a fourth sidewall located at a side of the first sidewall away from the second sidewall, and the base sidewall includes a fifth sidewall, the fourth sidewall and the fifth sidewall are oppositely arranged with a fourth interval therebetween, the fourth interval is larger the first interval, and the fourth interval is communicated with the first interval and the second interval, the assembly method further including: disposing sealant in the fourth interval to seal the first interval and the second interval.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

DETAILED DESCRIPTION

Figure 1A:
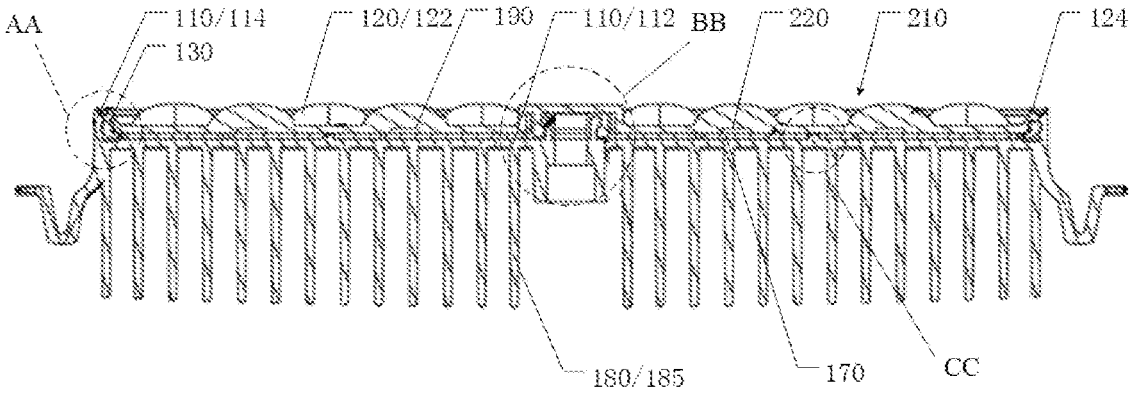
FIG. 1A is a schematic structural diagram of a lighting module according to an embodiment of the present disclosure.

In order to make objects, technical details and advantages of the embodiments of the disclosure apparent, the technical solutions of the embodiment will be described in a clearly and fully understandable way in connection with the drawings related to the embodiments of the disclosure. It is obvious that the described embodiments are just a part but not all of the embodiments of the disclosure. Based on the described embodiments herein, those skilled in the art can obtain other embodiment(s), without any inventive work, which should be within the scope of the disclosure.

Unless otherwise specified, the technical terms or scientific terms used in the disclosure shall have normal meanings understood by those skilled in the art. The words "first", "second" and the like used in the disclosure do not indicate the sequence, the number or the importance but are only used for distinguishing different components. The word "comprise", "include" or the like only indicates that an element or a component before the word contains elements or components listed after the word and equivalents thereof, not excluding other elements or components. The words "connection", "connected" and the like are not limited to physical or mechanical connection but may include electrical connection, either directly or indirectly.

A lighting module includes a base, a light emitting element, a lens component, and a heat sink; the base and the heat sink are integrated into a whole and form an accommodation space with the lens component, and the light emitting element is arranged in the accommodation space. Generally, an edge of the base of the lighting module and an edge of the lens component are both provided with grooves, and then a sealing ring is arranged in the grooves, and then a force is applied to the lens towards the base through a lens pressing frame or a buckle to compress the sealing ring in the groove, so that the above-mentioned accommodation space is sealed, and the sealing ring is subjected to a downward pressing force. In addition, sealant can be applied to the edges of the base and the lens component to enhance the sealing effect. Sealing the accommodation space can prevent external water and oxygen from corroding the light emitting element, thereby prolonging the service life of the lighting module.

However, the lens pressing frame or buckle will occupy a part of the area of the lens component, resulting in a decrease in the area ratio of the light emitting surface of the lens component and a decrease in the area of the accommodating space, thus reducing the number of light emitting elements per unit area and the light-transmitting area of the light-transmitting component, and further reducing the light emission efficiency.

In this regard, embodiments of the present disclosure provide a lighting module, an assembly method thereof, and a lighting device. The lighting module includes a base, a light-transmitting component and a sealing ring; the base includes a bottom plate and a base sidewall arranged on the bottom plate; the light-transmitting component is oppositely arranged with the base in a direction perpendicular to the bottom plate to form an accommodating space between the light-transmitting component and the bottom plate, and the light-transmitting component includes a light-transmitting component sidewall which is oppositely arranged at an interval with the bottom plate in a direction parallel to the bottom plate; and the sealing ring is at least partially arranged between the light-transmitting component sidewall and the base sidewall, and is in close contact with the light-transmitting component sidewall and the base sidewall respectively to seal the accommodating space. Therefore, the lighting module can seal the accommodation space through the base sidewall, the light-transmitting component sidewall and the sealing ring, without setting a pressing frame, a buckle or a screw on the edge of the light-transmitting component. Under the condition that an outer dimension of the lighting module is unchanged (the outer dimension herein do not include a structure for connecting the lighting module with the outside), an area of the accommodation space can be increased to set more light emitting elements, thereby improving the utilization rate of the light emitting surface of the lighting module, and improving the illumination brightness and luminous efficiency under the condition that the power of the lighting module is the same. In addition, the lighting module can also reduce the defective rate of products, save the installation steps, improve the installation efficiency and reduce the cost because there is no need to dispose a pressing frame, buckle or screw on the edge of the light-transmitting component.

Hereinafter, the lighting module, the assembly method and the lighting device provided by the embodiment of the present disclosure will be described in detail with reference to the accompanying drawings.

Figure 1B:
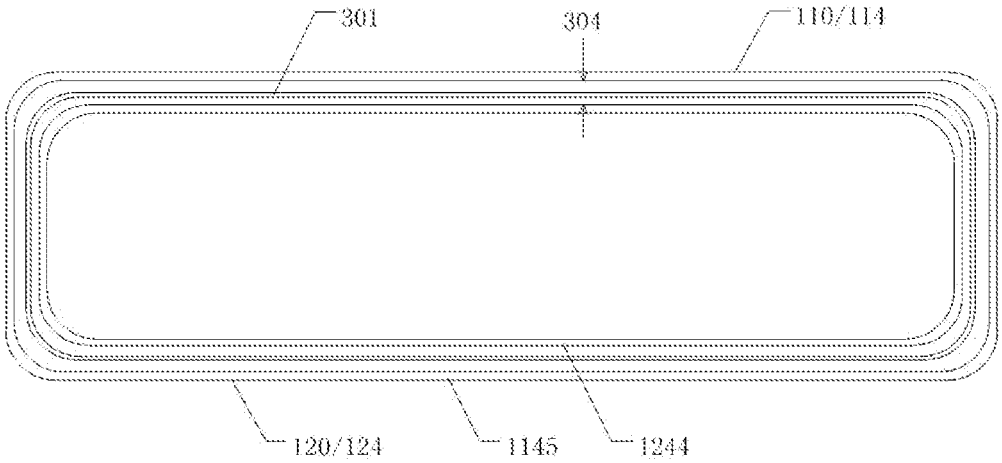
FIG. 1B is a schematic plan view of a lighting module according to an embodiment of the present disclosure.
Figure 2A:
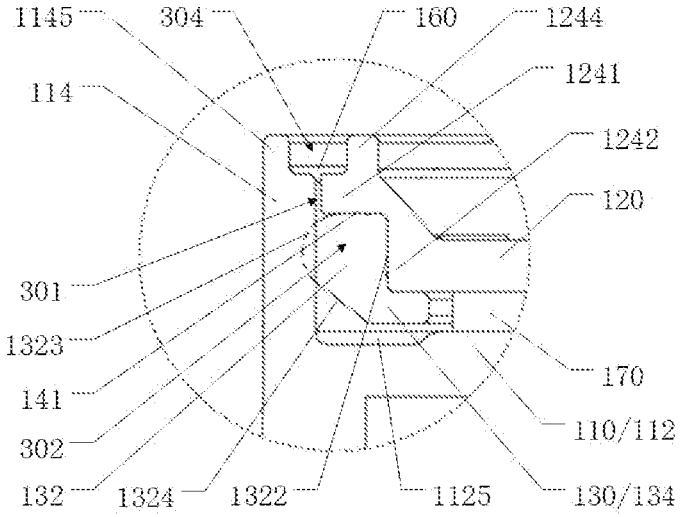
FIG. 2A is a partially enlarged schematic diagram of a lighting module according to an embodiment of the present disclosure in the AA area shown in FIG. 1A.

FIG. 1A is a schematic structural diagram of a lighting module according to an embodiment of the present disclosure; FIG. 1B is a schematic plan view of a lighting module according to an embodiment of the present disclosure; FIG. 2A is a partially enlarged schematic diagram of a lighting module according to an embodiment of the present disclosure in the AA area shown in FIG. 1A.

As illustrated by FIGS. 1A, 1B and 2A, the lighting module includes a base 110, a light-transmitting component 120 and a sealing component 130, for example, the sealing component 130 can be a sealing ring; the base 110 includes a bottom plate 112 and a base sidewall 114 arranged on the bottom plate 112, and the base sidewall 114 and the bottom plate 112 enclose an accommodating groove 210; the light-transmitting component 120 is at least partially arranged in the accommodating groove 210 to form an accommodating space 220 between the light-transmitting component 120 and the bottom plate 110, and the light-transmitting component 120 includes a light-transmitting component sidewall 124, the light-transmitting component sidewall 124 and the base sidewall 114 are oppositely arranged at an interval; the light-transmitting component 120 and the base 110 are arranged opposite to each other in a direction perpendicular to the bottom plate 112, and the light-transmitting component sidewall 124 and the base sidewall 114 are arranged opposite to each other in a direction parallel to the bottom plate 112. The sealing ring 130 is at least partially arranged between the light-transmitting component sidewall 124 and the base sidewall 114, and is in close contact with the light-transmitting component sidewall 124 and the base sidewall 114, respectively, so as to seal the accommodating space 220. It should be noted that both the base sidewall and the light-transmitting component sidewall as described above are structures having a certain thickness but not just two-dimensional surfaces. Similarly, all the sidewalls described in the following are also structures with a certain thickness but not just two-dimensional surfaces.

In the lighting module provided by the embodiment of the present disclosure, a light emitting element can be arranged in the accommodation space and is configured to emit light; furthermore, sealing the accommodation space can prevent external water and oxygen from corroding the light emitting element, thereby prolonging the service life of the lighting module. Because the sealing ring is arranged between the light-transmitting component sidewall and the base sidewall and is in close contact with the light-transmitting component sidewall and the base sidewall, respectively, the lighting module can seal the accommodation space through the sealing ring, the light-transmitting component sidewall and the base sidewall, that is, a lateral sealing mode is provided. In such case, the sealing ring is in a compressed state under a force perpendicular to the base sidewall, and the lighting module does not need to be provided with additional fixing structures such as a pressing frame, a buckle or a screw at the edge of the light-transmitting component. Under the condition that the outer dimension of the lighting module is unchanged, the area of the accommodation space of the lighting module can be increased to set more light emitting elements (such as light emitting diode lamp beads), so that the utilization rate of the light emitting surface of the lighting module can be improved, and the illumination brightness and luminous efficiency of the lighting module can be raised given the same power. In addition, the lighting module can also reduce the defective rate of products, save the installation steps, improve the installation efficiency and reduce the cost, because there is no need to arrange additional fixing structures such as a pressing frame, a buckle or a screw at the edge of the light-transmitting component. It is to be noted that, compared with the situation that the sealing ring is compressed by a force perpendicular to the bottom plate, in the case where the sealing ring is compressed by a force perpendicular to the base sidewall, a size of the sealing ring in the direction perpendicular to the base sidewall is smaller, which can further improve the utilization rate of the light emitting surface of the lighting module, and improve the illumination brightness and luminous efficiency given the same power.

Figure 2B:
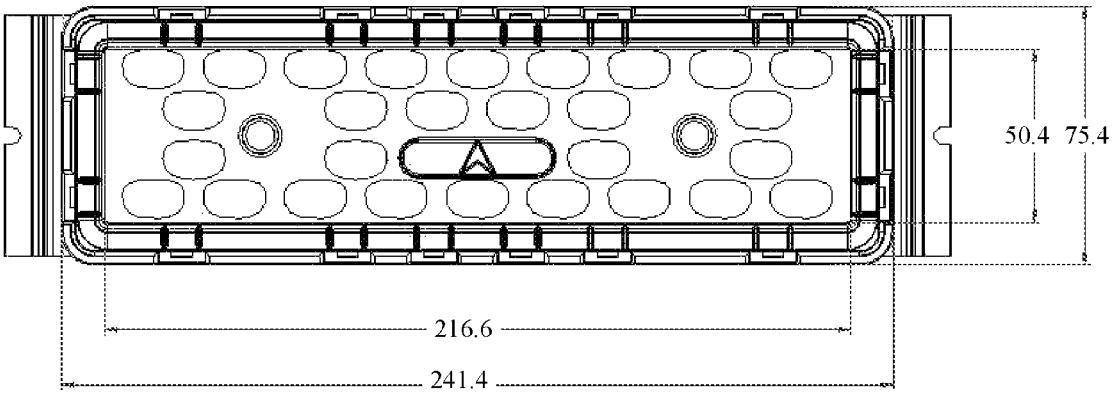
FIG. 2B is a dimensional diagram of a lighting module.
Figure 2C:
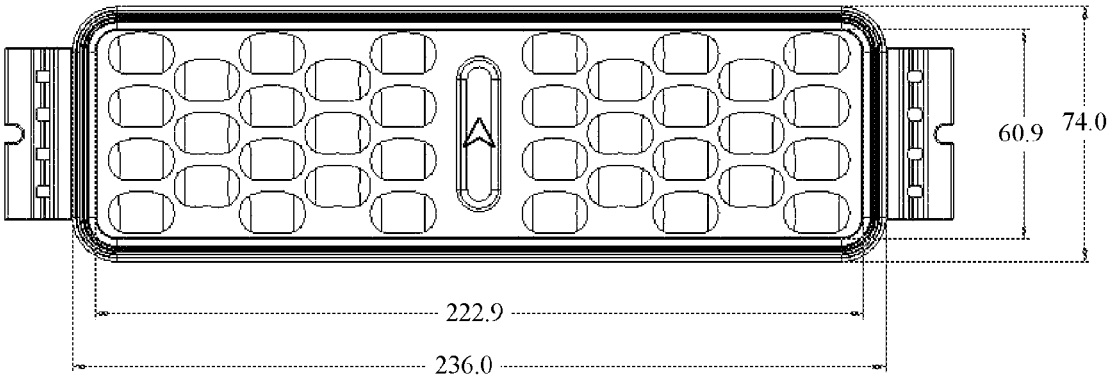
FIG. 2C is a dimensional diagram of a lighting module according to an embodiment of the present disclosure.

Comparative analysis with specific examples is provided as follows. FIG. 2B is a size diagram of a lighting module; FIG. 2C is a dimensional diagram of a lighting module according to an embodiment of the present disclosure. The sealing ring of the lighting module shown in FIG. 2B is arranged between the bottom plate of the base and the light-transmitting component, and occupies a part of the edge area of the light-transmitting component, and the sealing ring occupies a large area; in the lighting module provided by the embodiment of the disclosure, the sealing ring is arranged between the base sidewall and the light-transmitting component sidewall, so that the area originally occupied by the sealing ring in the edge area of the light-transmitting component in the lighting module shown in FIG. 2B can be used for arranging light emitting elements, and the utilization rate of the light emitting surface of the lighting module is greatly improved. In addition, the lighting module shown in FIG. 2B has two screw slots on the light-transmitting component, which also occupies a part of the area, and the screw slots are used to reserve space upon fixing the circuit board with screws. According to the lighting module provided by the embodiment of the present disclosure, a circuit board can be fixed without screws, and the screw slot is not needed to be arranged on the light-transmitting component, so that the utilization rate of the light emitting surface of the lighting module is further improved.

For example, as illustrated by FIG. 2B, a length and a width of an outer dimension of the lighting module (including a snap-in type pressing frame) are 241.4 mm*75.4 mm, the area where light emitting elements can be arranged on the lighting module is 216.6 mm*50.4 mm=10277 $mm^2$, the area occupied by two screw slots is 90 $mm^2$*2=180 $mm^2$, and the area occupied by a wiring slot is 460 $mm^2$, so the effective area where light emitting elements can be arranged is 10277 $mm^2$, and 28 light emitting elements can be provided. As illustrated by FIG. 2C, a length and a width of an outer dimension (including the base sidewall) of the lighting module according to one embodiment of the present disclosure is 236 mm*74 mm, the area where light emitting elements can be arranged on the lighting module is 222.9 mm*60.9 mm=13575 $mm^2$, and the area occupied by a wiring slot is 460 $mm^2$, that is, the effective area where light emitting elements can be arranged is 13115 $mm^2$, and 36 light emitting elements can be provided. The effective area where light emitting elements can be arranged on the lighting module provided by the present embodiment of the disclosure is increased by about 28%, compared with the effective area of the lighting module shown in FIG. 2B. The outer dimension of the lighting module according to this embodiment is slightly smaller than that of the lighting module according to FIG. 2B, but it can be arranged with about 8 more light emitting elements. Under the condition that the outer dimension of the lighting module is unchanged, the embodiment of the present disclosure can theoretically arrange more than 8 light emitting elements to further improve the utilization rate of the light emitting surface of the lighting module.

Figure 2D:
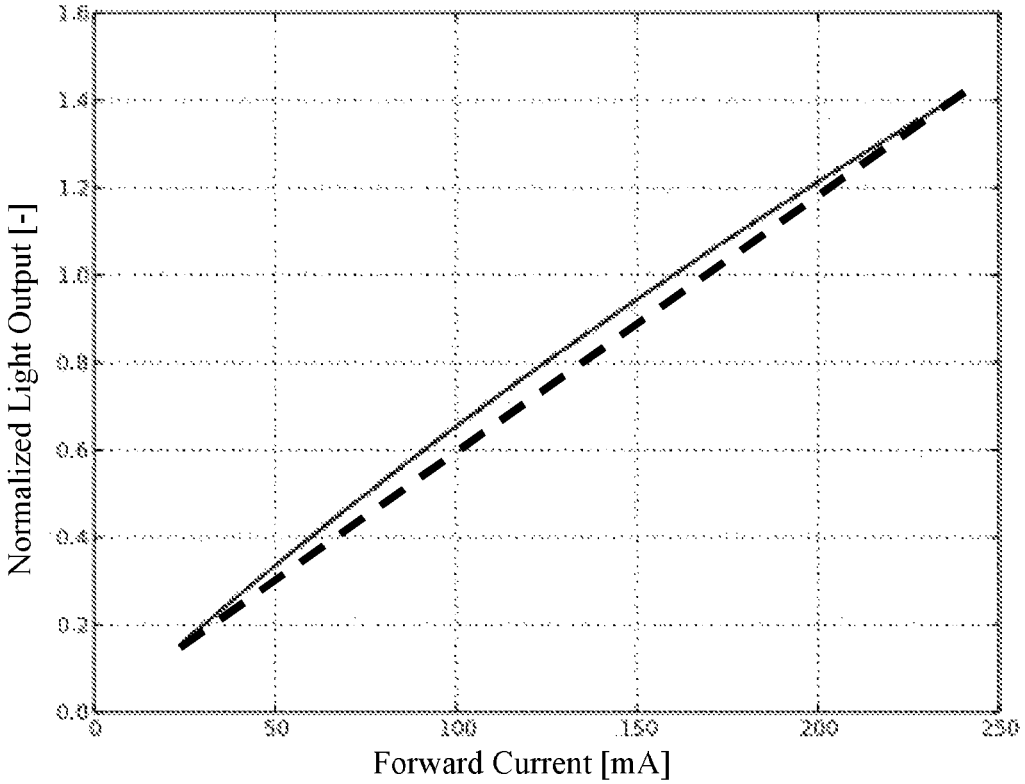
FIG. 2D is a graph showing a relationship between current and normalized luminous flux output of a single light emitting element.
Figure 2E:
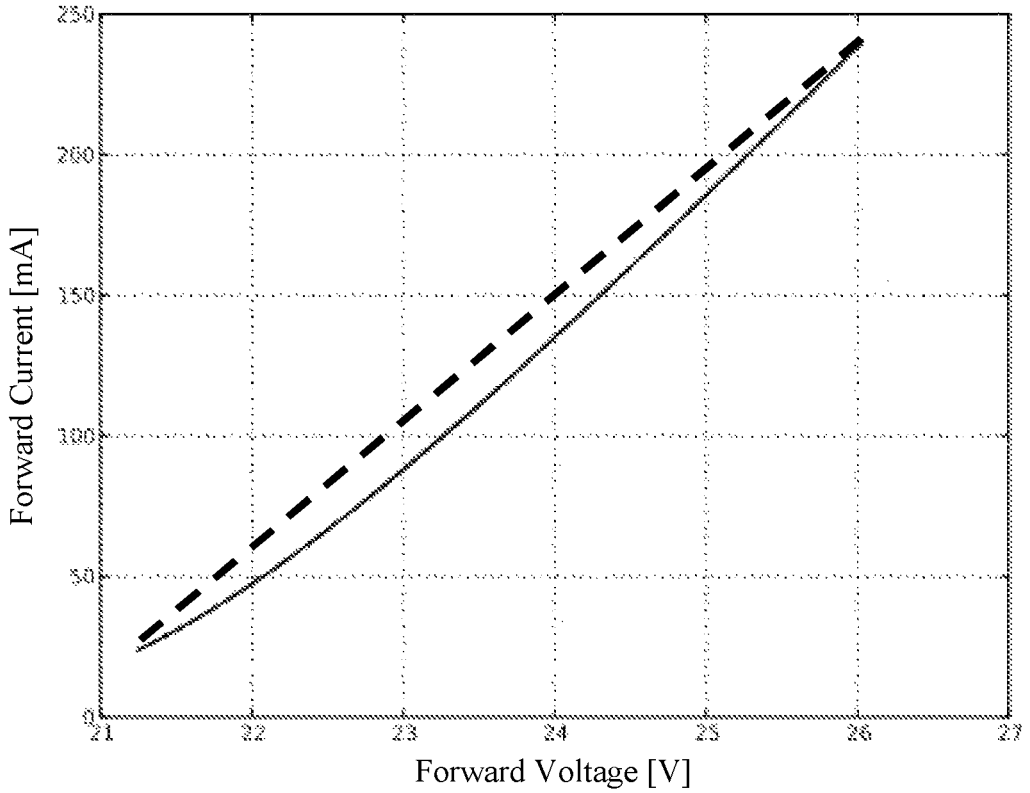
FIG. 2E is a graph showing a relationship between voltage and current of a single light emitting element.

Under the condition that power of the lighting module, light-transmitting efficiency of the light-transmitting component and photoelectric parameters of the light emitting elements are the same, the case where the power of the lighting module is 40 W, the light emitting element is LUXEON 5050 of Lumileds is described as an example, upon the number of the light emitting elements being 28, the driving current is about 60 mA; upon the number of the light emitting elements being 36, the driving current is about 47 mA; FIG. 2D is a graph showing a relationship between current and normalized luminous flux output of a single light emitting element; FIG. 2E is a graph showing a relationship between voltage and current of a single light emitting element (FIG. 2D and FIG. 2E are both from LUXEON 5050 product specification of Lumileds). Upon a testing current of the light emitting element being 160 mA, the luminous flux output by the single light emitting element is 650 lm; in FIG. 2D, 650 lm is normalized as a value of 1; according to the calculation formula of light emitting efficiency: the light emitting efficiency=luminous flux/power, a comparative analysis is provided in the following.

According to FIG. 2D, upon the driving current being 60 mA, the normalized luminous flux output by the light emitting element is about 0.4, and the actual luminous flux is 650 lm*0.4=260 lm; according to FIG. 2E, upon the current being 60 mA, the voltage being about 22.3V, and the luminous efficiency of the light emitting element is 260 lm/(60 ma*22.3V)≈194.32 lm/W.

According to FIG. 2D, upon the driving current being 47 mA, the normalized luminous flux output by the light emitting element is about 0.34, and the actual luminous flux is 650 lm*0.34=221 lm; according to FIG. 2E, upon the current being 47 mA, the voltage being about 21.9V, and the luminous efficiency of the light emitting element is 221 lm/(47 ma*21.9V)≈214.71 lm/W.

Compared with the lighting module shown in FIG. 2B, the lighting module according to one embodiment of the present disclosure can improve its luminous efficiency by (214.71−194.32)/194.32≈10.5% under the condition that the power of the lighting module, the light-transmitting efficiency of the light-transmitting component and the photoelectric parameters of the light emitting element are the same.

Figure 3A:
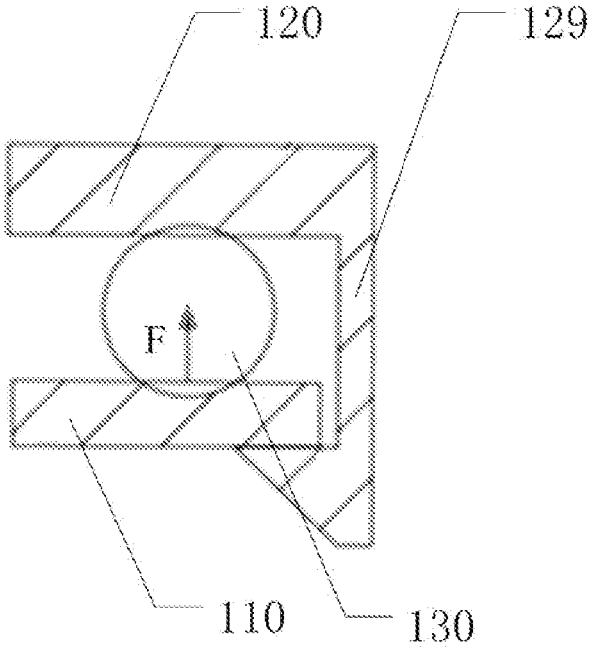
FIG. 3A is a schematic diagram of stress analysis of a lighting module.
Figure 3B:
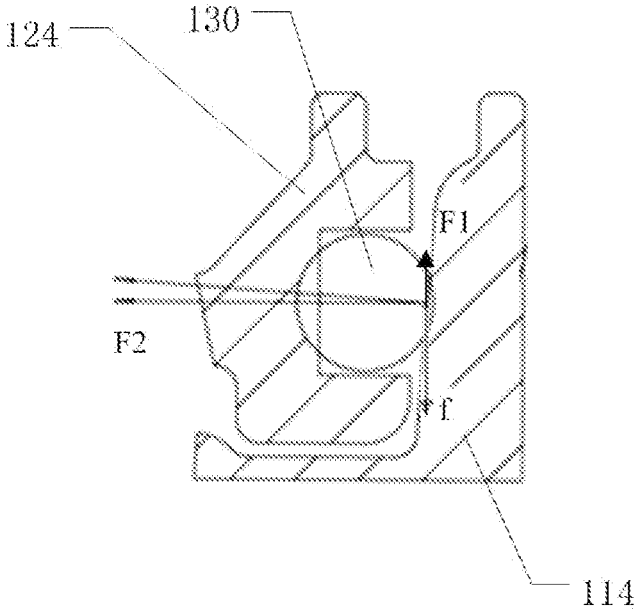
FIG. 3B is a schematic diagram of stress analysis of a lighting module according to an embodiment of the present disclosure.
Figure 3C:
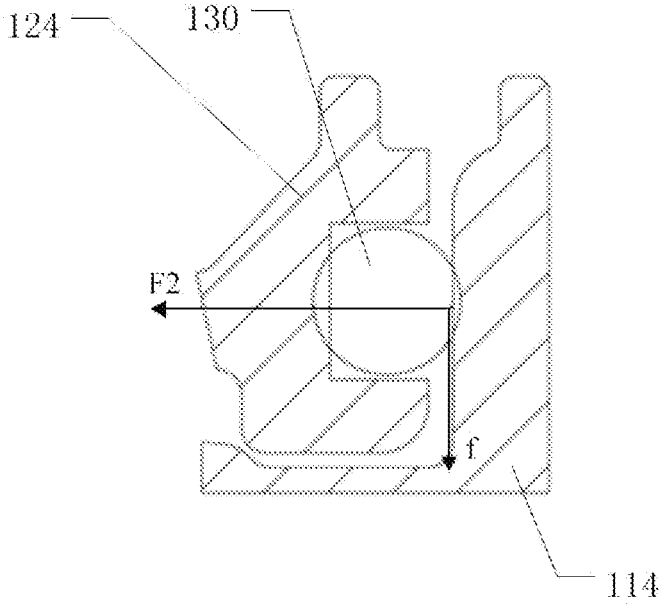
FIG. 3C is a schematic diagram of stress analysis of another lighting module provided by an embodiment of the present disclosure.
Figure 3D:
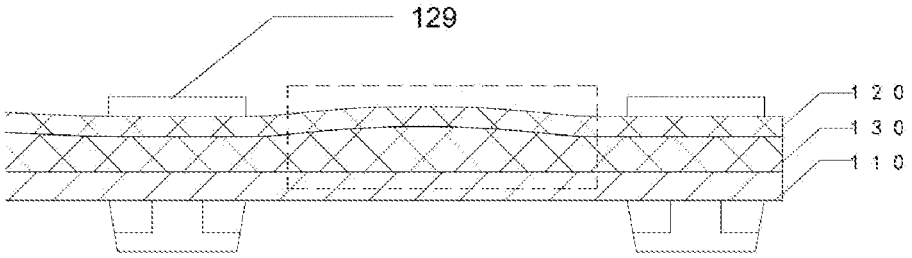
FIG. 3D is a schematic sectional view of a lighting module.
Figure 3E:
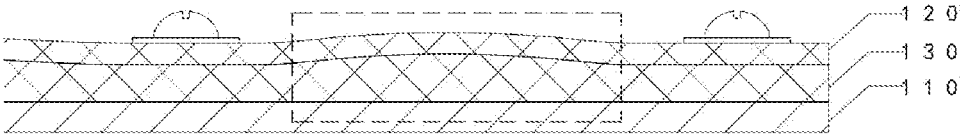
FIG. 3E is a schematic sectional view of another lighting module.
Figure 3F:
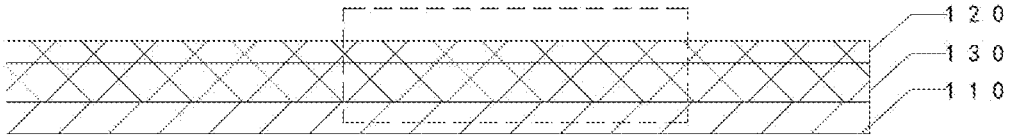
FIG. 3F is a schematic sectional view of another lighting module provided by an embodiment of the present disclosure.

FIG. 3A is a schematic diagram of stress analysis of a lighting module; FIG. 3B is a schematic diagram of stress analysis of a lighting module according to an embodiment of the present disclosure; FIG. 3C is a schematic diagram of stress analysis of another lighting module provided by an embodiment of the present disclosure; FIG. 3D is a schematic sectional view of a lighting module; FIG. 3E is a schematic sectional view of another lighting module; FIG. 3F is a schematic sectional view of another lighting module provided by an embodiment of the present disclosure.

As illustrated by FIG. 3D and FIG. 3E, the lighting module provided by the present disclosure generally fastens the transparent component 120 on the base 110 by using a tension force of buckles or screws, and the sealing ring is arranged between the transparent component and the base. Both buckles and screws are discontinuously arranged on the edge of the transparent component 120 at intervals. The pressing force on the transparent component 120 is uneven, and the downward force on the sealing ring is uneven. Given consideration to the cost, process, elastic deformation of buckles, interference between screws and other factors, the buckles and the screws cannot be arranged too close; upon a snap-in type light-transmitting component being fixed on the base, the maximum compression force that the buckle can bear depends on the strength of the buckle, and the buckle cannot be made very thick, otherwise it will affect its elastic deformation and cause the light-transmitting component to be unable to be installed. On the contrary, the buckle cannot be made very thin, otherwise its strength is not enough to cause it to break easily, thus affecting the installation effect; upon the light-transmitting component being fixed by screws, the force of screwing should not be too large, otherwise the light-transmitting component will be easily damaged. Even if the light-transmitting component does not break upon the screws having been screwed, the light-transmitting component has great internal stress due to the torque after the screws are tightened, which leads to the light-transmitting component being easily damaged during use. In addition, upon the light-transmitting component being fixed with buckles or screws, a part of the light-transmitting component between adjacent buckles (or screws) is easy to arch (as illustrated by the dashed frame in FIGS. 3D and 3E). At the arching position, the downward force on the sealing ring is reduced, and there is a hidden danger of water seepage.

The lighting module according to an embodiment of the present disclosure adopts a lateral sealing mode, as illustrated by FIG. 3F, the sealing ring is sealed by a lateral pressing force of the light-transmitting module sidewall and the base sidewall, both the light-transmitting module sidewall and the base sidewall are continuous, so the pressing force on the sealing ring is uniform and continuous. And, because the forces are mutual, the light-transmitting component sidewall is uniformly tensioned by the sealing ring. In this way, on the one hand, the light-transmitting component is easy to install on the base, and the light-transmitting component sidewall will not break, which will not affect the installation effect; at the same time, the light-transmitting component sidewall will not be arched, thereby avoiding the hidden danger of water seepage; on the other hand, in the use process, the light-transmitting component will not come loose from the base, and it can bear greater tooling force than the buckles by increasing the thickness of the light-transmitting component sidewall.

Hereinafter, the case where a snap-in type light-transmitting component is adopted, as an example of a conventional lighting module, is compared with the lighting module according to an embodiment of the present disclosure on the force analysis.

As illustrated by FIG. 3A, the lighting module is provided with a buckle 129 at an edge of the light-transmitting component 120 and engaged with the base 110, and a sealing ring 130 is arranged between the light-transmitting component 120 and the base 110, and is pressed and fixed by the buckle 129, so that the light-transmitting component 120 and the base 110 are fixed. In this case, after the sealing ring 130 receives a downward force F (the force in a direction from the light-transmitting component to the base) from the buckle 129, the base 110 will also generate an upward force F on the sealing ring 130.

As illustrated by FIG. 3B, the lighting module can be a lighting module provided by an embodiment of the present disclosure. As illustrated by FIG. 3B, in the case where there is a draft angle, assuming that a vertical component F1 of the force from the base sidewall 114 to the sealing ring 130 is F, a horizontal component F2 of the force from the base sidewall 114 to the sealing ring 130 is $F\cot\alpha$, and $\alpha$ is the draft angle (that is, the angle between the force from the base sidewall to the sealing ring and F2). Generally, the draft angle is very small, in the case where $\alpha=1$, F2=57.3F, and the maximum static friction force f generated by F2 is $\mu F2$, the friction coefficient is 0.8, and f=45.8F. A direction of the maximum static friction force f is opposite to the vertical component F1. It can be seen that the lighting module provided by the embodiment of the present disclosure can provide a force of f-F1=44.8F to prevent the light-transmitting component from loosening under the condition of the draft angle exists, and the lighting module can ensure that the sealing ring and the light-transmitting component do not come loose without setting a pressing frame, a buckle or a screw on the edge of the light-transmitting component. In addition, the lateral force F2 provided by the lighting module provided by the embodiment of the disclosure can reach 57.3F, so that the waterproof performance can be ensured.

As illustrated by FIG. 3C, the lighting module can be another lighting module provided by an embodiment of the present disclosure. As illustrated by FIG. 3C, in the case where the draft angle does not exist, that is, $\alpha=0$, the vertical component F1 of the force from the base sidewall 114 to the sealing ring 130 is 0, and only the horizontal force F2 exists. In this case, the force to prevent the light-transmitting component from loosening is f, and because there is no vertical component force, theoretically speaking, the lighting module can provide greater lateral force, and can better ensure that the sealing ring and the light-transmitting component do not loosen.

The above quantitative analysis is only for explaining that the lighting module provided by the embodiment of the present disclosure can provide greater force to compress the sealing ring. The above analysis process is only for drawing a qualitative conclusion, and the actual stress situation should be determined according to the actual stress demand of the project. According to Hooke's law, the stress in practical application depends on the compression amount of the sealing ring. The above analysis is only to show that the structural design of the lighting module provided by the embodiment of the disclosure can provide greater force to the sealing ring, so that the sealing ring can be subjected to greater static friction force, preventing the light-transmitting component from loosening, and because the sealing ring is pressed tighter, the sealing effect of the lighting module will be better.

For example, as illustrated by FIG. 1B, the base sidewall 114 can be a fence structure around the bottom plate, and similarly, the light-transmitting component sidewall 124 can also be a fence structure around the edge of the light-transmitting component 120. In this case, the sealing ring between the light-transmitting component sidewall 124 and the base sidewall 114 may have a corresponding annular structure.

For example, as illustrated by FIG. 1B, a shape of an orthographic projection of the base sidewall 114 on the bottom plate can be a rounded rectangular ring, and a shape of an orthographic projection of the light-transmitting component sidewall 124 on the bottom plate can be a rounded rectangular ring. Of course, the embodiments of the present disclosure include but are not limited thereto, and the shapes of the orthographic projections of the base sidewall and the light-transmitting component sidewall on the bottom plate can also be other annular structures as long as the accommodation space can be sealed.

In some examples, as illustrated by FIGS. 1A, 1B and 2A, the light-transmitting component 120 may be a lens component, i.e., including at least one lens portion 122. Of course, embodiments of the present disclosure include but are not limited thereto, and the light-transmitting component 120 can also be other light-transmitting components.

In some examples, as illustrated by FIGS. 1A, 1B and 2A, the light-transmitting component sidewall 124 is configured to apply a force, towards the base sidewall 114, to the sealing ring 130, so that the sealing ring 130 is in a compressed state.

In some examples, Shore hardness of the sealing ring ranges from 25 to 40. The greater the Shore hardness of the sealing ring, the harder the sealing ring is, and the greater the force needed to compress the sealing ring. Upon the sealing ring being compressed, a rebound force is easy to jack the light-transmitting component, thus causing various defects. However, the smaller the Shore hardness of the sealing ring and the softer the sealing ring, the larger the deformation of the sealing ring, which will easily lead to poor sealing effect. Therefore, by setting the Shore hardness of the sealing ring between 25 and 40, the lighting module according to the present example can have a good sealing effect (for example, it can pass the waterproof test), while the sealing ring will not generate a large rebound force. In addition, in the case where the Shore hardness of the sealing ring ranges from 25 to 40, the service life of the sealing ring is further prolonged.

For example, the Shore hardness of the sealing ring ranges from 25 to 30, which can give better consideration to the sealing effect and longer service life.

In some examples, a compression ratio of the sealing ring in the direction perpendicular to the base sidewall ranges from 15% to 22%. In this case, the lighting module can have a good sealing effect (for example, it can pass the waterproof test), and in this case, the sealing ring will not generate a large rebound force. It should be noted that the lighting module provided by the embodiment of the present disclosure can pass the waterproof test, such as IP68 waterproof grade test, when only the sealing ring is provided without sealant.

In some examples, in the case where a size of the second interval in a direction perpendicular to the base sidewall is W and a compression amount of the sealing ring in the direction perpendicular to the base sidewall is 6, the compression ratio calculation formula is:

$$E = \frac{\sigma}{W + \sigma} \times 100\%$$

In the case where the Shore hardness of the sealing ring ranges from 25 to 40, and the size of the second interval in the direction perpendicular to the base sidewall ranges from 2.1 to 2.3 mm, the waterproof test is carried out by selecting different compression amounts ($\sigma$), for example, the compression amounts ($\sigma$) are 1 mm, 0.7 mm, 0.6 mm, 0.5 mm and 0.4 mm respectively. According to the test results, in the case where the compression amount ($\sigma$) is 1 mm, the rebound force generated after the sealing ring is compressed is large, which will jack up the edge of the light-transmitting component; in the case where the compression amount ($\sigma$) is 0.7 mm, the rebound force of the sealing ring after compression is still large. in the case where the compression amount ($\sigma$) is 0.6 mm, the sealing ring will not jack up the edge of the light-transmitting component after being compressed, and pass the waterproof test; in the case where the compression amount ($\sigma$) is 0.5 mm, the sealing ring will not lift the edge of the lens after being compressed, and pass the waterproof test; in the case where the compression amount ($\sigma$) is 0.4 mm, the sealing ring will not lift the lens edge after being compressed, and it will pass the waterproof test. In the case where the compression ($\sigma$) is less than 0.4 mm, the compression force of the sealing ring is not enough, and it fails the waterproof test. Therefore, it can be concluded that the compression amount of the sealing ring in the direction perpendicular to the base sidewall ranges from 0.4 mm to 0.6 mm, and the compression ratio of the sealing ring in the direction perpendicular to the base sidewall ranges from 15% to 22%.

In some examples, as illustrated by FIG. 1A, FIG. 1B and FIG. 2A, the lighting module further includes a sealant 160, at least a part of which is located between the light-transmitting component sidewall 124 and the base sidewall 114 and on a side of the sealing ring 130 away from the bottom plate 112. For example, at least a part of the sealing ring 160 is located at an end of an interval between the light-transmitting component sidewall 124 and the base sidewall 114, which is located at a side of the sealing ring 130 away from the bottom plate 112. The sealing ring 130 can further seal and fix the light-transmitting component and the base.

In some examples, as illustrated by FIG. 1A, FIG. 1B and FIG. 2A, the light-transmitting component sidewall 124 includes a first sidewall 1241 and a second sidewall 1242; the first sidewall 1241 is located at a side of the second sidewall 1242 away from the base 110, that is, above the second sidewall 1242 shown in FIG. 2A. The first sidewall 1241 is arranged opposite to the base sidewall 114 with a first interval 301 therebetween. The second sidewall 1242 is arranged opposite to the base sidewall 114 with a second interval 302 therebetween. The second interval 302 is larger than the first interval 301, and the sealing ring 130 is at least partially arranged between the second sidewall 1242 and the base sidewall 114, and is in close contact with the second sidewall 1242 and the base sidewall 114, respectively. Therefore, the sealing ring is in close contact with the second sidewall and the base sidewall, respectively, and the accommodating space can be sealed. By setting the first sidewall which is closer to the base sidewall, the first sidewall can be located above the sealing ring, so that the sealing ring can be prevent from jumping out during the installation and use of the lighting module.

In some examples, as illustrated by FIGS. 1A, 1B and 2A, the side of the first sidewall 1241 close to the sealing ring 130 includes a first lateral surface 141, and the first lateral surface 141 is connected with the second sidewall 1242. The sealing ring 130 is in contact with the first lateral surface 141.

In some examples, as illustrated by FIGS. 1A, 1B and 2A, the surface of the first sidewall 1241 close to the base sidewall 114 and the surface of the second sidewall 1242 close to the base sidewall 114 are parallel. The first lateral surface 141 may be perpendicular to the surface of the second sidewall 1242 close to the base sidewall 114.

In some examples, as illustrated by FIG. 1A, FIG. 1B and FIG. 2A, the sealing ring 130 includes a first sealing portion 132, which is arranged between the light-transmitting component sidewall 124 and the base sidewall 114. Upon the sealing ring 130 being in an uncompressed state, the first sealing portion 132 includes a first flat surface 1322, a first arc surface 1323 and a first inclined surface 1324. The first flat surface 1322 is used for contacting with the second sidewall 1242; the first arc surface 1323 is opposite to the first flat surface 1322, protrudes outward and is configured to contact with the base sidewall 114. The first inclined surface 1324 is connected with the first arc surface 1323 and located at a side of the first arc surface 1323 close to the base 110. A plane where the first inclined surface 1324 is located and a plane where the first flat surface 1322 is located form an acute angle. The first inclined surface 1324 is configured to be spaced apart from the base sidewall 114 to form a deformation space. It should be noted that the above-mentioned first flat surface refers to a flat surface at least in the direction perpendicular to the bottom plate. In the case the shape of the orthographic projection of the sealing ring on the bottom plate is a rounded polygonal ring (for example, a rounded rectangular ring), the contact surface between the first sealing portion and the second sidewall at the rounded corner can be changed correspondingly according to the shape of the second sidewall. For example, in the case where the second sidewall at the rounded corner has a curved surface, a surface where the first sealing portion contacts the second sidewall may also be a curved surface.

In the lighting module according to the present example, the first flat surface 1322 is used to contact with the second sidewall 1242, so that the sealing ring 130 can have a good contact with the second sidewall 1242, so that the sealing ring 130 can be stably sleeved on the light-transmitting component 120, and the sealing ring 130 can be prevented from twisting. The first arc surface 1323 is opposite to the first flat surface 1322 and is used to contact with the base sidewall 114. The first arc surface 1323 has a certain guiding function, so that the sealing ring 130 can be extruded onto the base sidewall 114 more smoothly. The first inclined surface 1324 is connected with the first arc surface 1323. A plane where the first inclined surface 1324 is located and a plane where the first flat surface 1322 is located form an acute angle. On the one hand, the first inclined surface 1324 has a certain guiding function, which is convenient for installation; on the other hand, the first inclined surface 1324 can form a certain space with the bottom plate 112, which provides a reserved space upon the sealing ring 130 being compressed. It should be noted that the sealing ring 130 in FIG. 2A is in a compressed state, and the first arc surface can be shown with reference to the dotted line in FIG. 2A.

In some examples, as illustrated by FIGS. 1A, 1B and 2A, the first arc surface 1323 is in close contact with the base sidewall 114 and in a compressed state to form a contact surface, and the first inclined surface 1324 is located between the first sidewall 1241 and the bottom plate 112, and an orthographic projection of the first inclined surface 1324 on the bottom plate 112 at least partially overlaps with an orthographic projection of the second interval 302 on the bottom plate 112. Therefore, during installation, the first inclined surface 1324 can play a guiding role, which is convenient for installation. In addition, a certain space is formed between the first inclined surface 1324 and the bottom plate 112, thus providing a reserved space upon the sealing ring 130 being compressed. It should be noted that the size of the contact surface increases with the increase of the compression force on the sealing ring.

In some examples, as illustrated by FIGS. 1A, 1B and 2A, the sealing ring 130 further includes a second sealing portion 134, which is arranged between the light-transmitting component 120 and the bottom plate 112 and connected with the first sealing portion 132. The first sealing portion 132 and the second sealing portion 134 are of an integrated structure, and the sealing ring 130 can be better wrapped on the light-transmitting component 120 through the second sealing portion 134, and the sealing ring can be prevented from twisting upon the light-transmitting component 120 and the sealing ring 130 being pressed down to the base.

In some examples, as illustrated by FIGS. 1A, 1B and 2A, the lighting module further includes a circuit board 170 and at least one light emitting element 190 arranged on the circuit board 170; the circuit board 170 and the light emitting element 190 are both located in the accommodating space 220. Therefore, the circuit board 170 and the light emitting element 190 can be protected from being corroded by external water and oxygen, thus having longer service life and stability.

In some examples, as illustrated by FIGS. 1A, 1B and 2A, in the case where the light-transmitting component 120 is a lens component, at least one lens portion 122 and at least one light emitting element 190 may be arranged in one-to-one correspondence. Each of the at least one lens portion 122 can distribute light emitted from a corresponding one of the at least one light emitting element 190, thereby improving the light emitting effect of the lighting module.

In some examples, as illustrated by FIG. 2A, there is an interval between an edge of the circuit board 170 close to the base sidewall 114 and the base sidewall 114, and the second sealing portion 134 is arranged between the edge of the circuit board 170 close to the base sidewall 114 and the base sidewall 114. The second sealing portion 134 is not overlapped with the circuit board 170, so that the light-transmitting component 120 can be closely attached to the circuit board 170. Therefore, on the one hand, the light-transmitting component can play a role in fixing the circuit board, and on the other hand, the light emitting element on the circuit board can be closely attached to the lens portion, thereby improving the light emitting effect. In some examples, as illustrated by FIG. 2A, a size of the second sealing portion 134 in the direction perpendicular to the bottom plate 112 is smaller than a size of the circuit board 170 in the direction perpendicular to the bottom plate 112 (i.e., the thickness of the circuit board).

In some examples, as illustrated by FIGS. 1A, 1B and 2A, the lighting module further includes a heat sink 180; the heat sink 180 is arranged on a side of the bottom plate 112 away from the light-transmitting component 120, so as to dissipate heat for the light emitting elements arranged in the accommodating space.

In some examples, as illustrated by FIGS. 1A, 1B and 2A, the heat sink 180 and the base 110 may be of an integrated structure. That is to say, the heat sink is integrated on the surface of the base away from the light-transmitting component. In this case, the base can be made of a material with high thermal conductivity, such as metal, so as to improve the heat dissipation effect of the lamp shell. Of course, embodiments of the present disclosure include but are not limited thereto, and the base can also be made of other suitable materials.

In some examples, as illustrated by FIG. 1A, FIG. 1B and FIG. 2A, the heat sink 180 includes a plurality of heat sink fins 185 extending from a surface of the base 110 away from the light-transmitting component 120 along a direction away from the light-transmitting component 120, thereby having a better heat dissipation effect.

In some examples, in a natural state, a size of an inner circumference of the sealing ring 130 is smaller than a size of an outer circumference of the light-transmitting component 120, so that the sealing ring 130 can be firmly sleeved on the light-transmitting component. In addition, the size of the inner circumference of the sealing ring is smaller than the size of the outer circumference of the light-transmitting component, so that the sealing ring can be prevented from jumping out. It should be noted that, in the case where the light-transmitting component includes the first sidewall and the second sidewall, the size of the outer circumference of the light-transmitting component can be the size of the outer circumference of the second sidewall. It should be noted that, the above-mentioned natural state refers to a state where the sealing ring is not subjected to an external force.

Figure 4:
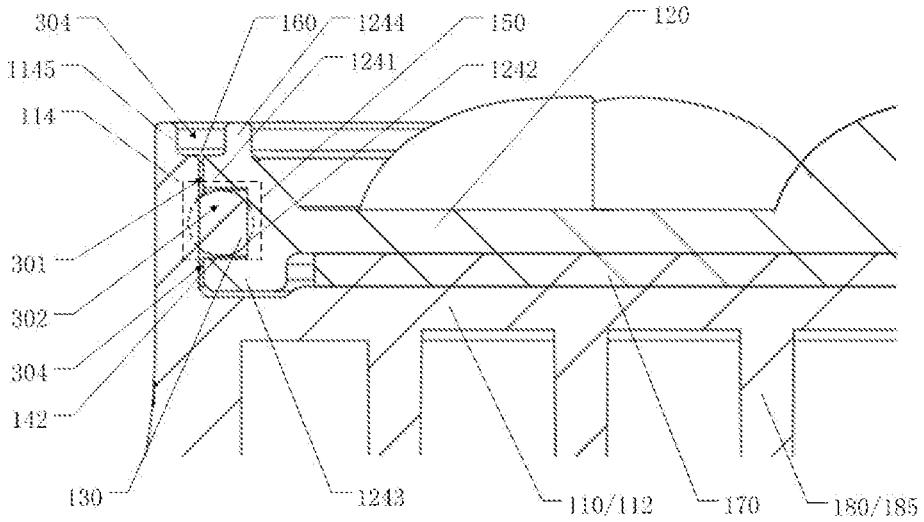
FIG. 4 is another partially enlarged schematic diagram of the lighting module according to an embodiment of the present disclosure in the AA area shown in FIG. 1A.

FIG. 4 is another partially enlarged schematic diagram of a lighting module according to an embodiment of the present disclosure in the AA area shown in FIG. 1A. As illustrated by FIG. 4, the light-transmitting component sidewall 124 further includes a third sidewall 1243; the third sidewall 1243 is arranged opposite to the base sidewall 114 with a third interval 303 therebetween, the third sidewall 1243 is located at a side of the second sidewall 1242 close to the bottom plate 112, and the third interval 303 is smaller than the second interval 302. The first sidewall 1241, the second sidewall 1242 and the third sidewall 1243 form a concave portion 150 which is concave towards the center of the light-transmitting component 120, and the sealing ring 120 is located in the concave portion 150. Therefore, the sealing ring 130 can be better embedded in the concave portion 150, and the sealing ring 130 can be prevented from being twisted and displaced during installation and use, so that the sealing effect can be improved.

In some examples, as illustrated by FIG. 4, the side of the third sidewall 1243 close to the sealing ring 130 has a second lateral surface 142, and the second lateral surface 142 is connected with the second sidewall 1242.

In some examples, as illustrated by FIG. 2A and FIG. 4, the light-transmitting component sidewall 124 includes a fourth sidewall 1244, which is located at a side of the first sidewall 1241 away from the bottom plate 112, and the base sidewall 114 includes a fifth sidewall 1145, the fourth sidewall 1244 and the fifth sidewall 1145 are oppositely arranged at an interval, and have a fourth interval 304, which is larger than the first interval 301. The fourth interval 304 is communicated with the first interval 301 and the second interval 302. The lighting module further includes a sealant 160 which is at least partially located in the fourth interval 304 to seal the first interval 301 and the second interval 302. Therefore, the fourth interval 304 and the sealant 160 can further seal the accommodation space 220. In addition, due to the small size of the first interval, it is difficult to fill the sealant in the first interval; the fourth interval is set larger than the first interval, so that the sealant can be filled better and the operation is convenient.

In some examples, as illustrated by FIGS. 2A and 4, a size of the fourth interval 304 in a direction perpendicular to the base sidewall 114 is much larger than a size of the first interval 301 in the direction perpendicular to the base sidewall 114, for example, the size of the fourth interval 304 in the direction perpendicular to the base sidewall 114 is much larger than four times of the size of the first interval 301 in the direction perpendicular to the base sidewall 114, so that sealant can be better filled.

In some examples, as illustrated by FIGS. 2A and 4, an orthographic projection of the first interval 301 on the bottom plate 112 falls within an orthographic projection of the fourth interval 304 on the bottom plate 112. That is, a surface of the fourth sidewall 1244 close to the base sidewall 114 is closer to the center of the lighting module than the surface of the first sidewall 1241 close to the base sidewall 114. Compared with the surface of the base sidewall 114 opposite to the first sidewall 1241, the surface of the fifth sidewall 1145 close to the fourth sidewall 1244 is further away from the center of the lighting module.

In some examples, as illustrated by FIGS. 2A and 4, the sealant 160 may be located in the first interval 301 and the second interval 302 and be in contact with the sealing ring 130. Of course, embodiments of the present disclosure include but are not limited thereto, and the sealant may only be located in the fourth interval.

It should be noted that, in the case where the light-transmitting component sidewall includes the third sidewall, a shape of the cross-sectional of the sealing ring can be a round shape, a horseshoe shape and other shapes, as long as the sealing effect can be achieved.

In some examples, as illustrated by FIGS. 2A and 4, the bottom plate 112 includes a groove 1125, which is located at a position of the bottom plate 112 close to the base sidewall 114, and an orthographic projection of the sealing ring 130 on the bottom plate 112 at least partially overlaps with the groove 1125. Therefore, as illustrated by FIG. 2A, the groove 1125 can provide a reserved space for expansion of the sealing ring, or as illustrated by FIG. 4, the groove 1125 can provide a reserved space for the third sidewall 1243.

Figure 5A:
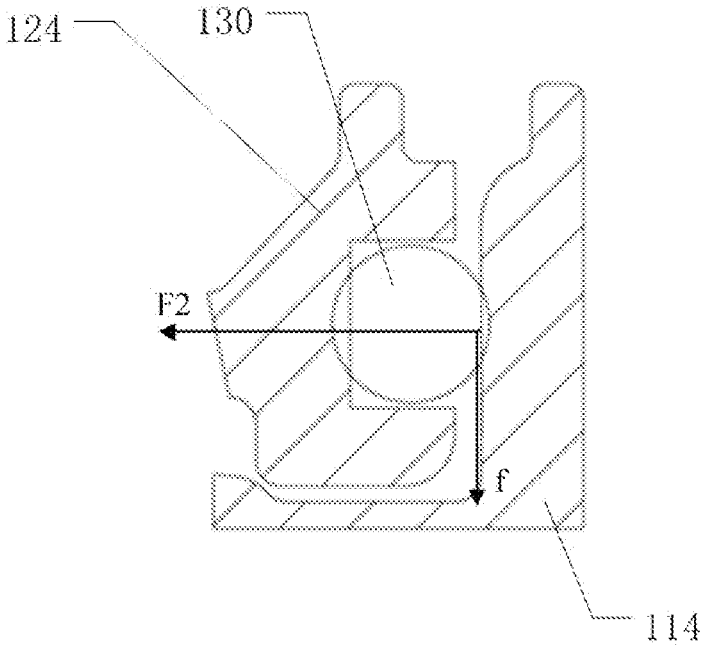
FIGS. 5A and 5B are partial enlarged schematic diagrams of another lighting module according to an embodiment of the present disclosure in the AA area shown in FIG. 1A.
Figure 5B:
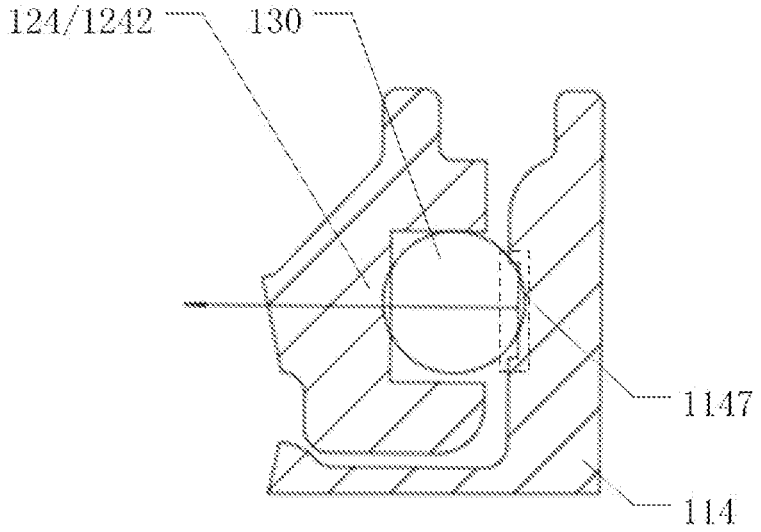

FIGS. 5A and 5B are partial enlarged schematic diagrams of another lighting module according to an embodiment of the present disclosure in the AA area shown in FIG. 1A. As illustrated by FIGS. 5A and 5B, the base sidewall 114 includes a recessed portion 1147 recessed from a surface of the base sidewall 114 close to the light-transmitting component sidewall 124. The recessed portion 1147 can be used to accommodate the sealing ring 130, thereby further preventing the sealing ring 130 from jumping out. For example, the recessed portion 1147 and the second sidewall 1242 may be oppositely arranged.

For example, as illustrated by FIG. 5A, the recessed portion 1147 may be a square recessed portion; as illustrated by FIG. 5B, the recessed portion 1147 is an arc-shaped recessed portion. For example, the recessed portion 1147 may be located at a side of the fifth sidewall 1145 close to the bottom plate 112.

Figure 6:
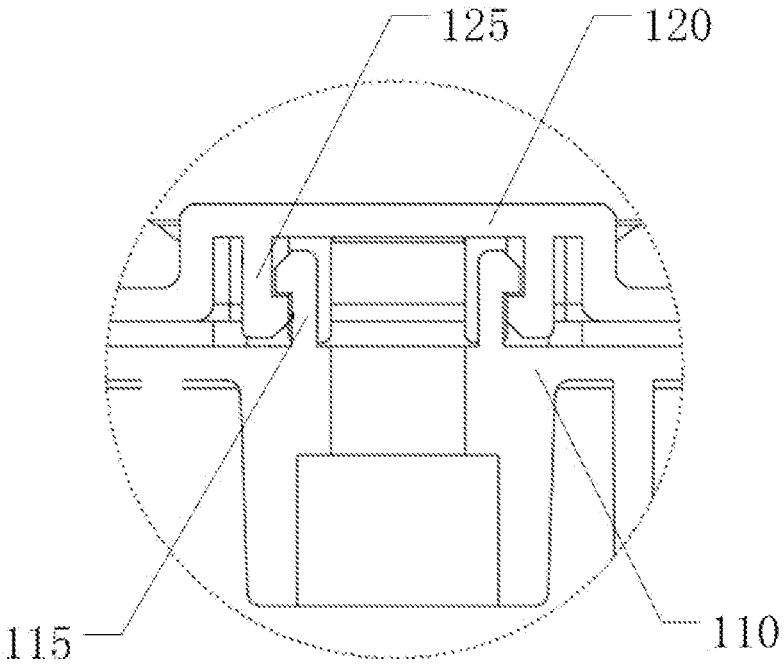
FIG. 6 is a partially enlarged schematic diagram of a lighting module according to an embodiment of the present disclosure in the BB area shown in FIG. 1A.

FIG. 6 is a partially enlarged schematic diagram of a lighting module according to an embodiment of the present disclosure in the BB area shown in FIG. 1A. As illustrated by FIGS. 1A and 6, the light-transmitting component 120 includes a first buckle 125 located at the center of the light-transmitting component 120, and the base 110 includes a second buckle 115 located at the center of the base 110. The first buckle 125 and the second buckle 115 cooperate with each other to connect with each other, thereby fixing the light-transmitting component 120 and the base 110. Therefore, the lighting module can be fixed through a buckle structure. In addition, by arranging the buckle structure at the center of the light-transmitting component and the center of the base, the center of the light-transmitting component can be better prevented from arching. Of course, the lighting module provided by the embodiment of the present disclosure may not be provided with the buckle structure, thereby reducing the manufacturing difficulty and the installation difficulty of the light-transmitting component and the base.

For example, the number of the first buckles 125 may be two, and the number of the second buckles 115 may also be two. Of course, the embodiments of the present disclosure include but are not limited thereto, and the number of the first buckles 125 and the number of the second buckles 115 may also be other numbers.

For example, both the first buckle 125 and the second buckle 115 have barb structures, and the barb structures of the first buckle 125 and the second buckle 115 are provided with inclined surfaces, which can play a guiding role and make it easier to buckle with each other during assembly.

Figure 7:
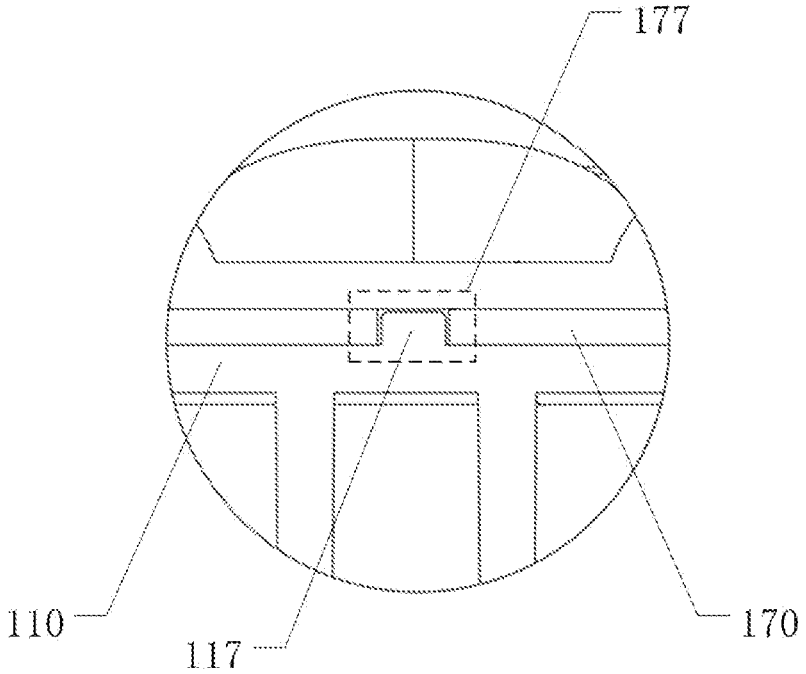
FIG. 7 is a partially enlarged schematic diagram of a lighting module according to an embodiment of the present disclosure in the CC area shown in FIG. 1A.

FIG. 7 is a partially enlarged schematic diagram of a lighting module according to an embodiment of the present disclosure in the CC area shown in FIG. 1A. As illustrated by FIG. 7, the light emitting elements 190 may be arranged on the circuit board 170, and both the circuit board 170 and the light emitting elements 190 thereon are arranged in the accommodating space.

It should be noted that, in the lighting module provided by the embodiment of the present disclosure, the circuit board and the base can be independent components. Of course, the circuit board and the base can be integrated into a whole, that is, a circuit structure is arranged on the bottom plate, and the light emitting element is directly arranged on the bottom plate.

In some examples, as illustrated by FIG. 7, the base 110 includes a positioning pin 117, and the circuit board 170 includes a positioning hole 177 configured to receive the positioning pin 117 and arranged in cooperation with the positioning pin 117. Therefore, the circuit board 170 can be fixed on the base 110 through the positioning pin 117 and the positioning hole 177.

In some examples, the circuit board 170 is a plate-like structure including a circuit structure for supplying power and controlling the light emitting elements 190; the circuit board 170 may be a printed circuit board (PCB).

In some examples, because the circuit board 170 can be fixed by the light-transmitting component 120, the light-transmitting component 120, the base 110 and the accommodating space 220 are not provided with screws, thereby reducing the installation difficulty and cost. In addition, because there is no need to be provided with screws, there is no need to reserve screw slots on the light-transmitting component 120, which can further improve the utilization rate of the light emitting surface of the lighting module, and there is no need to manufacture screw slots on the lighting module, which can reduce the defective rate of the lighting module.

Figure 8:
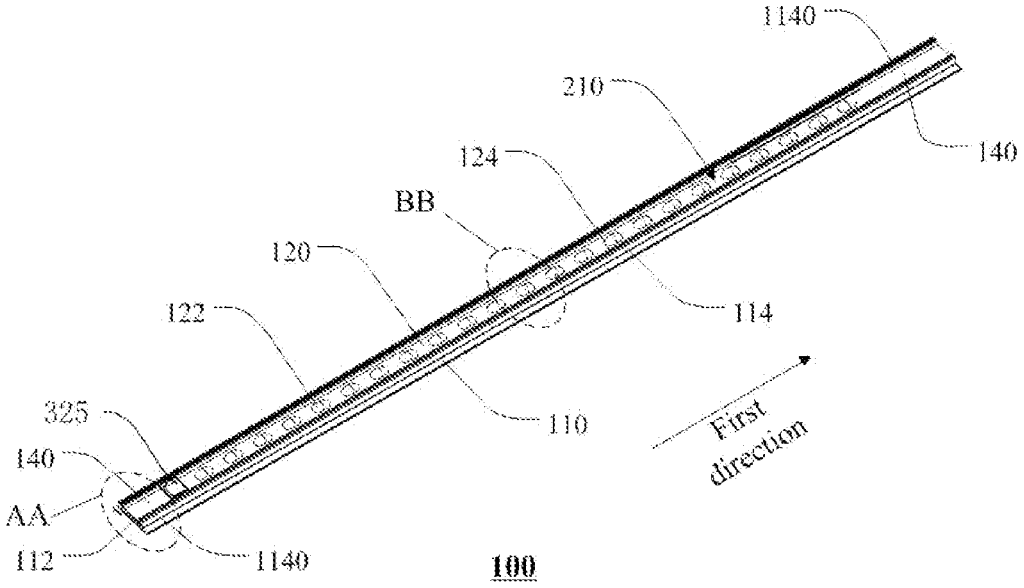
FIG. 8 is a structural diagram of a lighting module according to an embodiment of the present disclosure.
Figure 9:
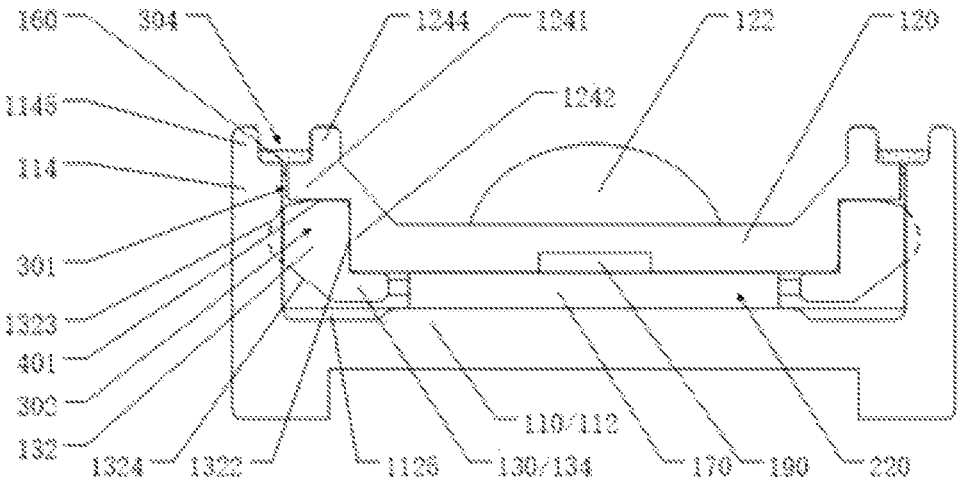
FIG. 9 is a schematic sectional view of the lighting module according to an embodiment of the present disclosure in the AA area shown in FIG. 8.

FIG. 8 is a structural diagram of a lighting module according to an embodiment of the present disclosure; FIG. 9 is a schematic sectional view of a lighting module according to an embodiment of the present disclosure in the AA area shown in FIG. 8.

As illustrated by FIGS. 8 and 9, the lighting module 100 includes a base 110, a light-transmitting component 120, a sealing structure 140 and a sealing component 130, for example, the sealing component 130 can be a sealing strip. The base 110 includes a bottom plate 112 and two base sidewalls 114 arranged on the bottom plate 112 and extending along a first direction, the two base sidewalls 114 are oppositely arranged and form an accommodating groove 210 with the bottom plate 112; the light-transmitting component 120 is at least partially arranged in the accommodating groove 210 to form an accommodating space 220 between the light-transmitting component 120 and the bottom plate 112, and the light-transmitting component 120 includes a light-transmitting component sidewall 124 arranged in the accommodating groove 210 and opposite to the two base sidewalls 114. The sealing structure 140 is located between the light-transmitting component 120 and the bottom plate 112, and at least located at two ends 1140 of the two base sidewalls 114 in the first direction, that is, besides the two ends 1140 of the two base sidewalls 114 in the first direction, the sealing structure 140 can also be arranged at other positions to enhance the sealing performance. The sealing strip 130 is at least partially arranged between the light-transmitting component sidewall 124 and the base sidewall 114 which are correspondingly arranged, and the sealing strip 130 is in close contact with the light-transmitting component sidewall 124 and the base sidewall 114, respectively. The sealing strip 130 and the sealing structure 140 collectively seal the accommodating space. It should be noted that both the base sidewall and the light-transmitting component sidewall are of a certain thickness, not just two-dimensional surfaces. Similarly, all kinds of sidewall hereinafter are structures with a certain thickness, not just two-dimensional surfaces.

In the lighting module provided by the embodiment of the present disclosure, a light emitting element can be arranged in the accommodation space, which is used for emitting light, and sealing the accommodation space can prevent external water and oxygen from corroding the light emitting element, thereby prolonging the service life of the lighting module. The lighting module can seal the two sides of the accommodation space in the first direction by the sealing structure (e.g., curable sealant), and seal the two sides of the accommodation space in the direction perpendicular to the first direction by the base sidewall, the light-transmitting component sidewall and the sealing strip, so that the accommodation space can be isolated from the water and oxygen of the external environment, and there is no need to be provided with a pressing frame, a buckle or a screw on the edge of the light-transmitting component. Therefore, under the condition that the outer dimension of the lighting module is unchanged, the lighting module can increase the area of the accommodation space to arrange more light emitting elements (such as light emitting diode lamp beads), thereby improving the utilization rate of the light emitting surface of the lighting module and improving the illumination brightness and luminous efficiency under the condition that the power of the lighting module is unchanged. In addition, the lighting module can also reduce the defective rate of products, save the installation steps, improve the installation efficiency and reduce the cost because there is no need to be provided with additional fixing structures such as a pressing frame, a buckle or a screw on the edge of the light-transmitting component. It is to be noted that, compared with the situation that the sealing strip is compressed by a force perpendicular to the bottom plate, in the case where the sealing strip is compressed by the force perpendicular to the base sidewall, the size of the sealing strip in the direction perpendicular to the base sidewall is smaller, which can further improve the utilization rate of the light emitting surface of the lighting module, and improve the illumination brightness and luminous efficiency under the condition that the power of the lighting module is unchanged.

On the other hand, because the two base sidewalls 114 both extend along the first direction on the bottom plate 112, the two base sidewalls 114 can be arranged parallel to each other. Therefore, the base can be conveniently manufactured by adopting a profile extrusion molding process, thereby reducing the manufacturing cost of the base and further reducing the manufacturing cost of the lighting module.

For example, the base can be made of plastic, aluminum and other materials which are convenient for extrusion molding. Of course, the embodiments of the present disclosure include but are not limited thereto, and the base can also be made of other materials.

In the lighting module provided by the embodiment of the disclosure, upon the sealing strip being in a compressed state due to the force perpendicular to the base sidewall, there is static friction between the sealing strip and the base sidewall, so that the lighting module can ensure that the sealing strip and the light-transmitting component are not easy to come out of the accommodating groove without setting a pressing frame, a buckle or a screw on the edge of the light-transmitting component, and the lighting module has a good sealing effect.

In some examples, as illustrated by FIGS. 8 and 9, the light-transmitting component 120, the base 110 and the accommodating space 220 are not provided with a screw, which can reduce the defective rate of products, save installation steps, improve installation efficiency and reduce cost.

In some examples, as illustrated by FIGS. 8 and 9, the light-transmitting component 120 may be a lens component, that is, the light-transmitting component 120 includes at least one lens portion 122. Of course, embodiments of the present disclosure include but are not limited thereto, and the light-transmitting component 120 can also be other light-transmitting components.

In some examples, as illustrated by FIGS. 8 and 9, the light-transmitting component sidewall 124 is configured to apply a force, towards the base sidewall 114, to the sealing strip 130, so that the sealing strip 130 is in a compressed state, thereby more tightly sealing both sides of the accommodation space in a direction perpendicular to the first direction.

In some examples, Shore hardness of the sealing strip ranges from 25 to 40. The greater the Shore hardness of the sealing strip, the harder the sealing strip is, and the greater the force needed to compress the sealing strip. Upon the sealing strip being compressed, a rebound force is easy to jack the light-transmitting component, thus causing various defects. However, the smaller the Shore hardness of the sealing strip and the softer the sealing strip, the larger the deformation of the sealing strip, which will easily lead to poor sealing effect. Therefore, by setting the Shore hardness of the sealing strip between 25 and 40, the lighting module according to the present example can have a good sealing effect (for example, it can pass the waterproof test), while the sealing strip will not generate a large rebound force. In addition, in the case where the Shore hardness of the sealing strip ranges from 25 to 40, the service life of the sealing strip is further prolonged.

For example, the Shore hardness of the sealing strip ranges from 25 to 30, which can give better consideration to the sealing effect and longer service life.

In some examples, in the case where the Shore hardness of the sealing strip ranges from 25 to 40, and a size of the second interval in the direction perpendicular to the base sidewall ranges from 2.1 to 2.3 mm, through many experiments, in the case where the compression amount of the sealing strip in the direction perpendicular to the base sidewall ranges from 0.4 to 0.6 mm, and the compression ratio of the sealing strip in the direction perpendicular to the base sidewall ranges from 15% to 22%, the sealing strip will not generate a large rebound force. It should be noted that the embodiments of the present disclosure include but are not limited thereto, and the compression amount and compression ratio of the sealing strip can also have other values as long as a certain waterproof effect is ensured.

In some examples, as illustrated by FIG. 8, the light-transmitting component 120 further includes an anti-glare structure 325 located at positions where the two ends 1140 of the two base sidewalls 114 in the first direction are located. For example, the anti-glare structure 125 is located outside the lens portion 112, that is, the anti-glare structure 125 is located at a side close to the edge of the light-transmitting component 120 in the first direction. Therefore, the anti-glare structure can play a role in preventing glare.

For example, as illustrated by FIG. 8, the anti-glare structure 325 may be a bump protruding from the surface of the light-transmitting component 120 away from the base 110 in the direction away from the base 110, so as to block the propagation direction of the light emitting element close to the edge of the light-transmitting component 120 in the first direction, thereby playing a role in preventing glare.

Figure 10A:
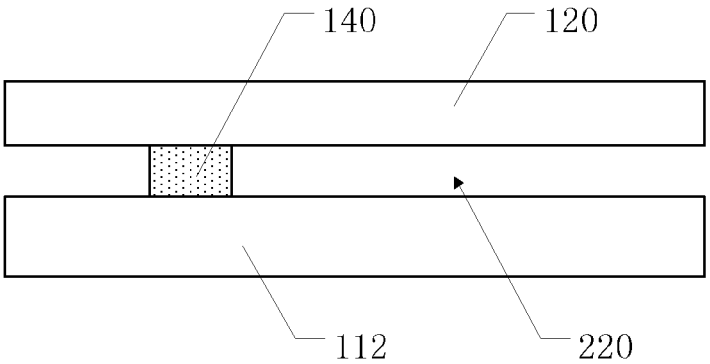
FIG. 10A is a schematic cross-sectional diagram of a lighting module according to an embodiment of the present disclosure along a first direction in the AA area shown in FIG. 1.

FIG. 10A is a schematic cross-sectional diagram of a lighting module according to an embodiment of the present disclosure in the AA area shown in FIG. 8 along the first direction. As illustrated by FIG. 10A, the sealing structure 140 is a curable sealant, and the curable sealant is located between the light-transmitting component 120 and the bottom plate 112 to seal two sides of the accommodating space 220 in the first direction.

Figure 10B:
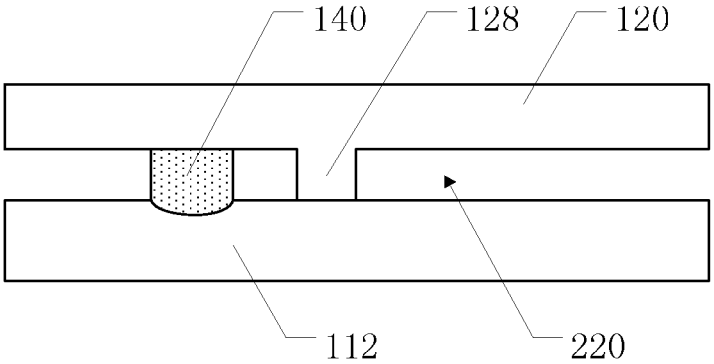
FIG. 10B is a schematic cross-sectional diagram of another lighting module according to an embodiment of the present disclosure along a first direction in the AA area shown in FIG. 1.

FIG. 10B is a schematic cross-sectional diagram of another lighting module according to an embodiment of the present disclosure in the AA area shown in FIG. 8 along the first direction. As illustrated by FIG. 10B, the light-transmitting component 120 further includes blocking sidewalls 128, which are arranged at the positions of the two sides of the accommodating space 220 in the first direction, so as to prevent the sealing structure from entering the accommodating space 220.

Figure 11:
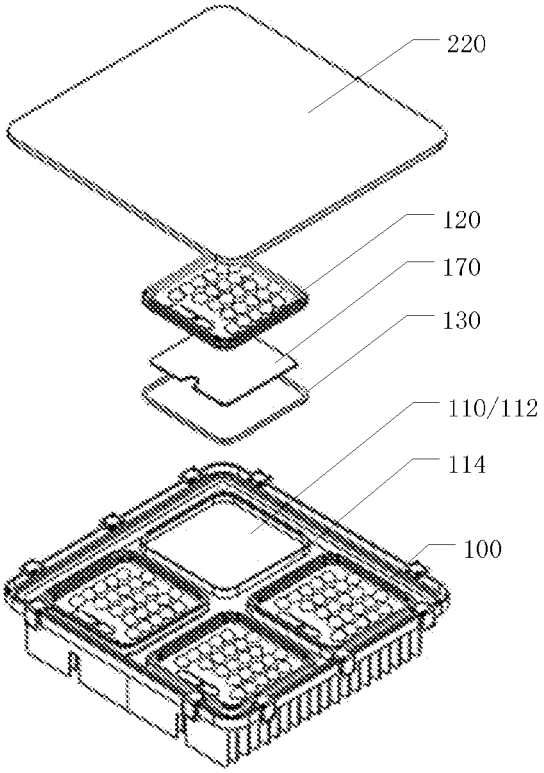
FIG. 11 is a structural diagram of a lighting device according to an embodiment of the present disclosure.

An embodiment of the present disclosure also provides a lighting device. FIG. 11 is a structural diagram of a lighting device according to an embodiment of the present disclosure. As illustrated by FIG. 11, the lighting device 200 includes the lighting module 100 described above. Therefore, the lighting device also has the beneficial effects corresponding to the beneficial effects of the lighting module, and the repeated portions are omitted herein. For details, please refer to the related description of the lighting module.

In some examples, the lighting device can be a street lamp, a stadium lamp, an airport lamp and the like.

In some examples, as illustrated by FIG. 11, the lighting device 200 includes a plurality of lighting modules 100; bases 110 of the plurality of lighting modules 100 are spliced with each other or integrated into a whole, and base sidewalls 114 of the plurality of lighting modules 100 are arranged at intervals, so that the mutual influence of heat among the lighting modules can be reduced. That is to say, the plurality of lighting modules can share a base, and a plurality of base sidewall are arranged on the base to form a plurality of accommodating grooves; and an interval is provided between two adjacent base sidewalls.

Figure 12:
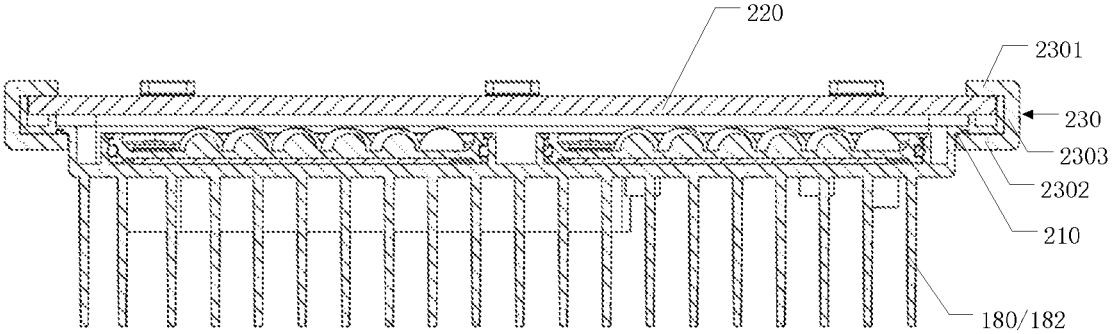
FIG. 12 is a schematic sectional view of a lighting device according to an embodiment of the present disclosure.

FIG. 12 is a schematic cross-sectional diagram of a lighting device according to an embodiment of the present disclosure. As illustrated by FIG. 12, the lighting device further includes an extension wall 210, a transparent cover plate 220 and a module buckle 230. The extension wall 210 extends outward from the bottom plate 112 of the base 110, and the transparent cover plate 220 is located at a side of the light-transmitting component 120 away from the bottom plate 112. The module buckle 230 is configured to fix the transparent cover plate 220 on the extension wall 210. Because the lighting device adopts an integrated design, it is convenient to install; in the case where the lighting device is equipped with a plurality of lighting modules, the lighting device can place a plurality of lighting modules on the lamp shell at the same time and fix them uniformly, thereby simplifying the installation process and saving time and labor.

For example, as illustrated by FIG. 12, the module buckle 230 includes an upper edge 2301, a lower edge 2302 and a lateral edge 2303 connecting the upper edge 2301 and the lower edge 2302; the upper edge 2301 is located at a side of the transparent cover plate 230 away from the bottom plate 112 and at the edge of the transparent cover plate 230, and the lower edge 2302 is located at a side of the extending wall 210 away from the transparent cover plate 230. The lateral edge 2303 connects the upper edge 2301 and the lower edge 2302, so that the upper edge 2301 and the lower edge 2302 can exert force on the transparent cover plate 230 and the extension wall 210, respectively, to fix the transparent cover plate 220 on the extension wall 210.

For example, the lighting device may include a plurality of module buckles which are arranged at intervals at the edge of the lighting device. Of course, the embodiments of the present disclosure include but are not limited thereto, and the lighting device may only include one module buckle, which is arranged around the edge of the lighting device.

For example, the transparent cover plate 230 can be a glass plate, a plastic plate or other transparent plates. In the case where the transparent cover plate 230 is a glass plate, it can have high strength and light transmittance at the same time, and can play a self-cleaning role.

For example, an anti-glare pattern may be provided on the transparent cover plate 230 to prevent glare. For example, the anti-glare pattern may include silk screen printing.

Figure 13:
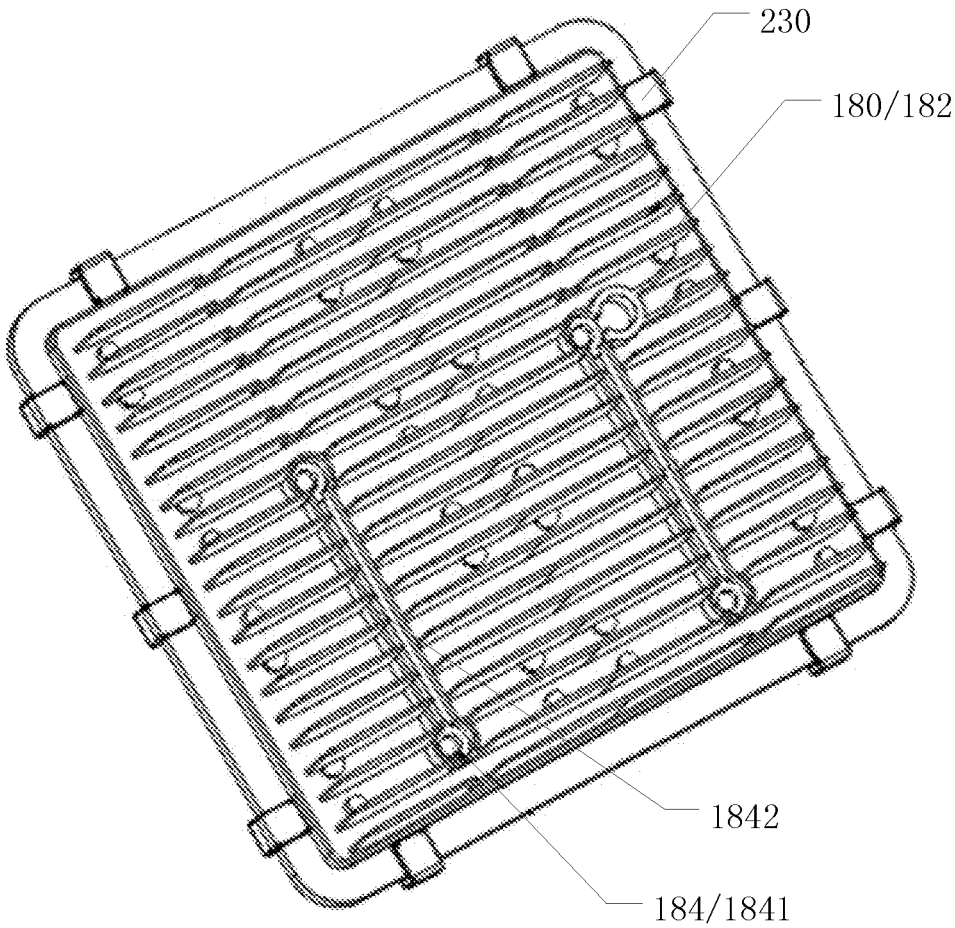
FIG. 13 is a schematic structural diagram of another lighting device according to an embodiment of the present disclosure.

FIG. 13 is a schematic structural diagram of another lighting device according to an embodiment of the present disclosure. As illustrated by FIG. 13, the lighting module further includes a heat sink 180; the heat sink 180 is arranged on a side of the bottom plate 112 away from the light-transmitting component 120. The heat sink 180 includes a plurality of heat sink fins 182. The heat sink 180 is provided with a notch area 184, and the notch area 184 can be provided with a wire passing hole 1841 for installing a power wire of the lighting module 100.

For example, two adjacent wire passing holes 1841 can be communicated through a groove 1842, and the groove 1842 can be provided with a conductive structure and filled with sealant, so that the power wires of a plurality of lighting modules 100 can be connected in series, in parallel, etc., and finally only two wires (positive and negative connecting wires) can be led out, thereby saving the cost. The sealant filled in the groove 1842 can waterproof and seal the wire passing hole and prevent the wires from being exposed and damaged.

Figure 14:
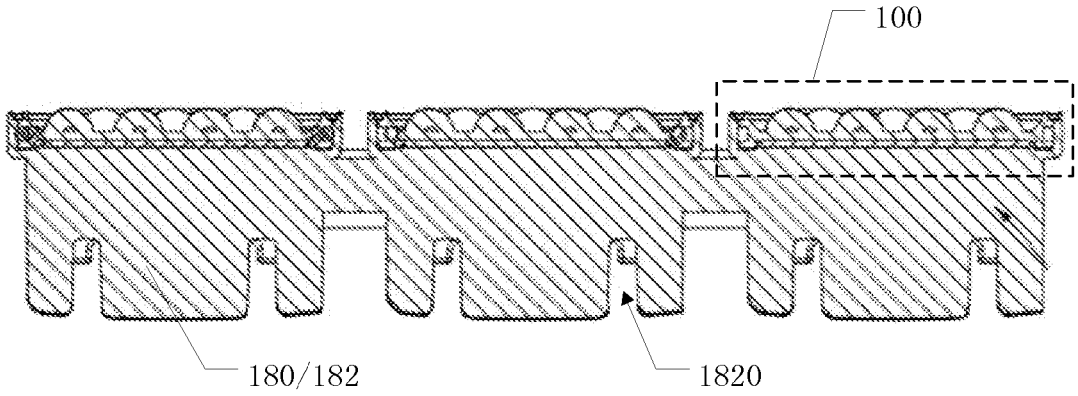
FIG. 14 is a schematic structural diagram of another lighting device according to an embodiment of the present disclosure.
Figure 15:
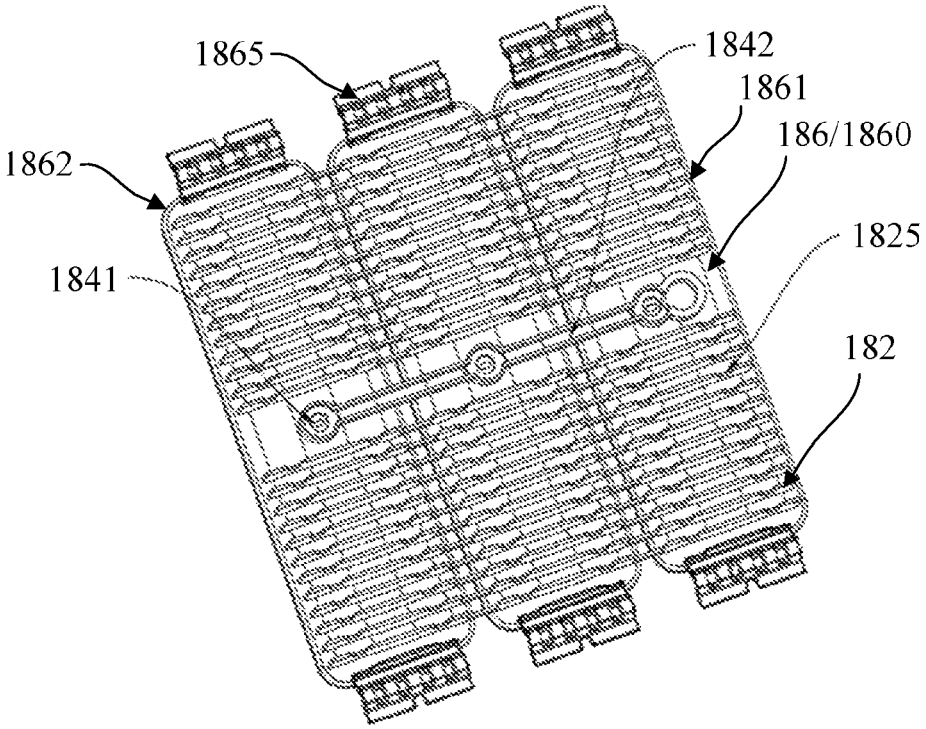
FIG. 15 is a schematic structural diagram of another lighting device according to an embodiment of the present disclosure.

FIG. 14 is a schematic structural diagram of another lighting device according to an embodiment of the present disclosure. As illustrated by FIG. 14, the lighting device 200 includes a plurality of lighting modules 100, which share a heat sink fin 182, and the lighting modules 100 are connected by the heat sink fin 182 to form an integrated structure. For example, the plurality of lighting modules 100 and the plurality of sub heat sink plates 1860 are arranged in one-to-one correspondence, and adjacent sub heat sink plates 1860 are arranged at intervals and connected through the heat sink fins 182. FIG. 15 is a schematic structural diagram of another lighting device according to an embodiment of the present disclosure. As illustrated by FIG. 15, the heat sink 180 includes a heat sink plate 186, and the heat sink plate 186 may include a plurality of sub heat sink plates 1860. For example, lateral surfaces of adjacent sub heat sink plates 1860 are connected. The lighting device 200 includes a plurality of lighting modules 100, which are arranged one to one with the sub heat sink plates 1860, and the base 110 of each of the plurality of lighting modules 100 is fixed on a corresponding one of the plurality of sub heat sink plates 1860.

In some examples, as illustrated by FIG. 15, the heat sink plate 186 is an integrally formed single component.

In some examples, as illustrated by FIG. 15, the base 110 of each of the plurality of lighting modules 100 and the corresponding one of the plurality of sub heat sink plates 1860 can be integrated into a whole, thereby reducing the structural complexity of the lighting module.

In some examples, as illustrated by FIG. 15, a plurality of heat sink fins 182 are provided on a side of each of the plurality of sub heat sink plates 1860 away from the light-transmitting component 120.

In some examples, as illustrated by FIG. 15, each of the plurality of heat sink fins 182 is provided with a plurality of heat sink notches 1825. The heat sink notches 1825 allow the heat sink fins 182 to be convenient for spraying molding, and the heat sink notches 1825 facilitate air circulation, thereby further enhancing the heat dissipation capability of the heat sink 180.

In some examples, as illustrated by FIG. 15, the heat sink plate 186 and the plurality of heat sink fins 182 are integrally formed by die casting. Therefore, the heat conduction ability between the heat sink plate 186 and the heat sink fins 182 is stronger, thereby enhancing the heat dissipation ability of the heat sink 180.

In some examples, as illustrated by FIG. 15, each of the plurality of sub heat sink plates 1860 includes two long edges 1861 and two short edges 1862, and the two short edges 1862 are respectively provided with a fixing portion 1865 configured to be connected with an external lamp shell.

In some examples, as illustrated by FIG. 15, each of the plurality of sub heat sink plates 1860 is provided with a wire passing hole 1841. The wire passing hole 1841 is used to install a power wire of the lighting module 100.

Figure 16:
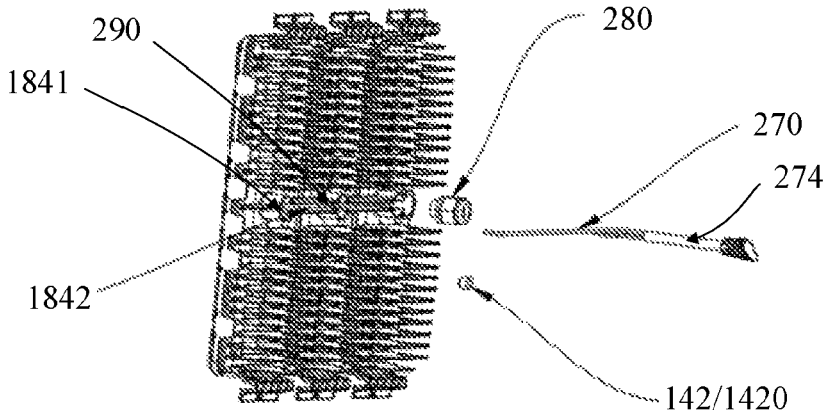
FIG. 16 is a schematic structural diagram of another lighting device according to an embodiment of the present disclosure.

FIG. 16 is a schematic structural diagram of another lighting device provided by an embodiment of the present disclosure. As illustrated by FIG. 16, a sealing plug 142 may also be arranged in the wire passing hole 1841, and the sealing plug 142 passes through the wire passing hole 1841 and has a through hole 1420 allowing a wire to pass through.

In some examples, as illustrated by FIG. 16, the lighting device 200 further includes a plurality of power wires 270, which are arranged in one-to-one correspondence with a plurality of wire passing holes 1841, and a first end of each of the plurality of power wires 270 penetrates through a through hole 1420 of a corresponding sealing plug 142. Therefore, the first end of the power cord 270 can be connected with the lighting module 100 through the sealing plug 142, and has high waterproof performance.

In some examples, as illustrated by FIG. 16, a communication groove 1842 is provided on a side of the heat sink plate 186 away from the light-transmitting component 120, the communication groove 1842 connects a plurality of wire passing holes 1841 of the plurality of sub heat sink plates 1860, and second ends of the plurality of power wires 270 are converged through the communication groove 1842 and have a lead-out end 274. For example, the plurality of power wires 270 can be connected in series or parallel in the communication groove 1842 and finally led out through the lead-out end 274 (positive and negative connecting lines), thereby saving cost, and making it easy to seal the plurality of power wires.

In some examples, as illustrated by FIG. 16, the lighting device 200 further includes a threaded pipe 280, which is fixed at the periphery of any one of the plurality of wire passing holes 1841, and the lead-out end 274 passes through the threaded pipe 280 and is fastened by the threaded pipe 280.

In some examples, as illustrated by FIG. 16, the lighting device 200 further includes a sealing unit 290, for example, a sealant, located in the communication groove 1842 and sealing the plurality of power wires 270 in the communication groove 1842.

Figure 17:
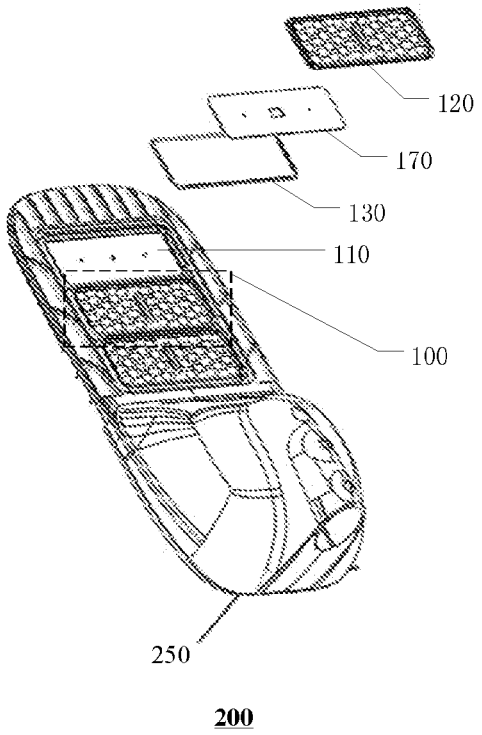
FIG. 17 is a schematic structural diagram of another lighting device according to an embodiment of the present disclosure.

FIG. 17 is a schematic structural diagram of another lighting device according to an embodiment of the present disclosure. As illustrated by FIG. 17, the lighting device 200 can be a lamp, including a plurality of lighting modules 100 and a lamp housing 250. The bases 110 and the lamp housings 250 of the plurality of lighting modules 100 can be integrally formed. In addition, there is an interval between adjacent lighting modules 100, which can reduce the mutual influence of heat between lighting modules. In addition, a variety of positioning structures can be arranged in the lamp housing 250 to facilitate automatic production, thereby improving installation efficiency and reducing cost.

Figure 18:
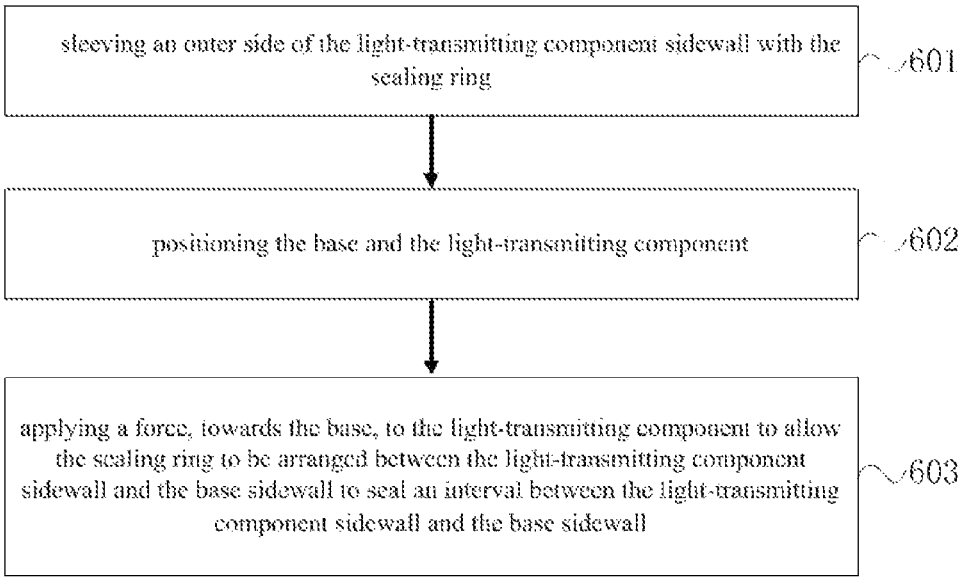
FIG. 18 is a flowchart of an assembly method of a lighting module according to an embodiment of the present disclosure

An embodiment of the present disclosure also provides an assembly method of a lighting module, which can be the lighting module provided by any of the above examples. FIG. 18 is a flowchart of an assembly method of a lighting module according to an embodiment of the present disclosure. As illustrated by FIG. 18, the assembly method of the lighting module includes the following steps S601-S603.

S601: sleeving an outer side of the light-transmitting component sidewall with the sealing ring.

S602: positioning the base and the light-transmitting component.

S603: applying a force, towards the base, to the light-transmitting component to allow the sealing ring to be arranged between the light-transmitting component sidewall and the base sidewall to seal an interval between the light-transmitting component sidewall and the base sidewall. It should be noted that, although the light-transmitting component is applied with a force towards the base, the force that makes the sealing ring in a compressed state is not the force applied towards the base, but the force between the light-transmitting component sidewall and the base sidewall, which is approximately perpendicular to the base sidewall.

In the assembly method of the lighting module provided by the embodiment of the disclosure, the light-transmitting component can be pressed from top to bottom by using a flat tooling, so that the light-transmitting component is applied with a force towards the base. In the process of pressing the light-transmitting component, the sealing ring around the light-transmitting component is squeezed by the base sidewall to produce a certain amount of compression, thus achieving the sealing effect. In addition, the assembly method has the advantages of simple steps, high assembly efficiency, low cost and the like.

In some examples, in the case where the lens sidewall includes a fourth sidewall located at a side of the first sidewall away from the second sidewall, and the base sidewall includes a fifth sidewall, the fourth sidewall and the fifth sidewall are oppositely arranged with a fourth interval therebetween, the fourth interval is larger the first interval, and the fourth interval is communicated with the first interval and the second interval, the assembly method further includes: disposing sealant in the fourth interval to seal the first interval and the second interval, so as to achieve the double sealing effect.

In some examples, before applying the force, towards the base, to the light-transmitting component to allow the sealing ring to be arranged between the light-transmitting component sidewall and the base sidewall to seal the interval between the light-transmitting component sidewall and the base sidewall, the assembly method may further includes: heating the base (for example, the temperature is 160-170 degrees Celsius, the time is 4-5 minutes), so that the base expands to a certain extent, thereby further reducing the assembly difficulty.

In some examples, in the case where the lighting module includes a circuit board, the assembly method further includes fixing the circuit board through a positioning hole and a positioning pin on the bottom plate; upon the force, towards the base, being applied to the light-transmitting component to allow the sealing ring to be arranged between the light-transmitting component sidewall and the base sidewall to seal the interval between the light-transmitting component sidewall and the base sidewall, the lens component can tightly press the circuit board on the base.

An embodiment of the present disclosure also provides a lighting module. Referring to FIGS. 1A-7, the lighting module includes a base 110, a light-transmitting component 120 and a circuit board 170. The base 110 includes a bottom plate 112 and a base sidewall 114 arranged on the bottom plate 112, and the base sidewall 114 and the bottom plate 112 enclose an accommodating groove 210. The light-transmitting component 120 is at least partially arranged in the accommodating groove 210 to form an accommodating space 220 between the light-transmitting component 120 and the bottom plate 110, and the light-transmitting component 120 includes a light-transmitting component sidewall 124, the light-transmitting component sidewall 124 and the base sidewall 114 are oppositely arranged at an interval; the circuit board 170 is arranged in the accommodating space 220. At least a part of the light-transmitting component 120 abuts against a surface of the circuit board 170 away from the bottom plate 112 to fix the circuit board 170 in a direction perpendicular to the bottom plate 112.

In the lighting module provided by the embodiment of the disclosure, by disposing at least a part of the light-transmitting component to abut against a surface of the circuit board away from the bottom plate, the circuit board can be fixed on the bottom plate in the direction perpendicular to the bottom plate. Therefore, the lighting module is not provided with a screw, which can reduce the assembly difficulty and improve the assembly efficiency on the one hand, and reduce the cost on the other hand. In addition, the lighting module is not provided with a screw, and can be assembled only by pressing, thus facilitating automatic assembly.

In some examples, referring to FIGS. 1A-7, the circuit board 170 includes a first positioning structure 177, such as a positioning hole 177, and the base 110 includes a second positioning structure 117, such as a positioning pin 117; The first positioning structure 177 and the second positioning structure 117 cooperate with each other to fix the circuit board 170 in a direction parallel to the bottom plate 112.

In some examples, referring to FIGS. 1A-7, the lighting module further includes at least one light emitting element 190, which is arranged on the circuit board 170 and configured to emit light towards the light-transmitting component 120, and the light-transmitting component 120 includes at least one lens portion 122, and the at least one lens portion 122 is arranged in one-to-one correspondence with the at least one light emitting element 190.

In some examples, referring to FIGS. 1A-7, the light-transmitting component 120 includes a plurality of lens portions 122 arranged in an array, and a portion abutting against the circuit board 170 is arranged around at least one of the plurality of lens portions 122.

In some examples, referring to FIGS. 1A-7, a portion abutting against the circuit board 170 is provided around each of the plurality of lens portions 122.

For example, referring to FIGS. 1A-7, a portion of the light-transmitting component 120 abutting against the circuit board 170 is in direct contact with the circuit board 170.

For example, referring to FIGS. 1A-7, the accommodation space 220 is provided with no screws therein, so that the installation difficulty and cost can be reduced.

For example, the light emitting element can be a light emitting diode. Of course, the embodiments of the present disclosure include but are not limited thereto, and the above-mentioned light emitting elements can also be other types of light emitting diodes.

The foregoing are only some embodiments of this disclosure, but the protection scope of this disclosure is not limited thereto. Based on the above embodiments, this disclosure can include the following technical solutions:

(1) A lighting module, including: a base, including a bottom plate and a base sidewall arranged on the bottom plate, the base sidewall and the bottom plate enclosing an accommodating groove; a light-transmitting component, at least partially arranged in the accommodating groove to form an accommodating space between the light-transmitting component and the bottom plate, the light-transmitting component including a light-transmitting component sidewall, and the light-transmitting component sidewall and the base sidewall being oppositely arranged at an interval; and a sealing ring, at least partially arranged between the light-transmitting component sidewall and the base sidewall, and being in close contact with the light-transmitting component sidewall and the base sidewall, respectively, so as to seal the accommodating space.

(2) The lighting module according to item (1), wherein the Shore hardness of the sealing ring ranges from 25 to 40.

(3) The lighting module according to item (1), wherein a compression ratio of the sealing ring in a direction perpendicular to the base sidewall ranges from 15% to 22%.

(4) The lighting module according to item (1), wherein a compression amount of the sealing ring in the direction perpendicular to the base sidewall ranges from 0.4 to 0.6 mm.

(5) The lighting module according to any one of items (1) to (4), further including a sealant, at least a part of which is located at an end of an interval between the base sidewall and the lens sidewall, and the end is located at a side of the sealing ring away from the bottom plate.

(6) The lighting module according to any one of items (1) to (5), wherein the light-transmitting component sidewall is configured to apply a force, towards the base sidewall, to the sealing ring, so that the sealing ring is in a compressed state.

(7) The lighting module according to any one of items (1) to (4), wherein the light-transmitting component sidewall includes: a first sidewall arranged opposite to the base sidewall and having a first interval with the base sidewall; and a second sidewall arranged opposite to the base sidewall, and having a second interval with the base sidewall; the first sidewall is located at a side of the second sidewall away from the base, and the second interval is larger than the first interval; and the sealing ring is at least partially arranged between the second sidewall and the base sidewall and in close contact with the second sidewall and the base sidewall, respectively.

(8) The lighting module according to item (7), wherein the sealing ring includes a first sealing portion arranged between the light-transmitting component sidewall and the base sidewall, upon the sealing ring being in an uncompressed state, the first sealing portion includes a first flat surface configured to contact with the second sidewall; a first arc surface arranged opposite to the first flat surface, protruding outward and configured to contact with the base sidewall; and a first inclined surface connected with the first arc surface and located at a side of the first arc surface close to the base, and a plane where the first inclined surface is located and a plane where the first flat surface is located form an acute angle.

(9) The lighting module according to item (7), wherein the first arc surface is in close contact with the base sidewall and in a compressed state to form a contact surface, the first inclined surface is located between the first sidewall and the bottom plate, and an orthographic projection of the first inclined surface on the bottom plate at least partially overlaps with an orthographic projection of the second interval on the bottom plate.

(10) The lighting module according to item (7), wherein the base sidewall includes a recessed portion recessed from a surface of the base sidewall close to the light-transmitting component sidewall and configured to accommodate a part of the sealing ring.

(11) The lighting module according to item (7), wherein the sealing ring further includes a second sealing portion arranged between the light-transmitting component and the bottom plate and connected to the first sealing part.

(12) The lighting module according to item (11), further including a circuit board located in the accommodation space; and at least one light emitting element arranged on the circuit board and configured to emit light towards the light-transmitting component, wherein the light-transmitting component includes at least one lens portion, and the at least one lens portion is arranged in one-to-one correspondence with the at least one light emitting element.

(13) The lighting module according to item (12), wherein an interval is provided between an edge of the circuit board close to the base sidewall and the base sidewall, and the second sealing portion is arranged between the edge of the circuit board close to the base sidewall and the base sidewall.

(14) The lighting module according to item (7), wherein the light-transmitting component sidewall further includes a third sidewall arranged opposite to the base sidewall and having a third interval with the base sidewall, the third sidewall is located at a side of the second sidewall close to the bottom plate, the third interval is smaller than the second interval, and the first sidewall, the second sidewall and the third sidewall form a concave portion concaved towards a center of the light-transmitting component, and the sealing ring is located in the concave portion.

(15) The lighting module according to item (7), wherein the light-transmitting component sidewall includes a fourth sidewall located at a side of the first sidewall away from the bottom plate, and the base sidewall includes a fifth sidewall, and the fourth sidewall and the fifth sidewall are oppositely arranged with a fourth interval therebetween, the fourth interval is larger than the first interval and is communicated with the first interval and the second interval; the lighting module further includes a sealant, at least located in the fourth interval to seal the first interval and the second interval.

(16) The lighting module according to item (14), wherein an orthographic projection of the first interval on the bottom plate falls within an orthographic projection of the fourth interval on the bottom plate.

(17) The lighting module according to any one of items (1) to (16), wherein the bottom plate includes a groove, and an orthographic projection of the sealing ring on the bottom plate at least partially overlaps with the groove.

(18) The lighting module according to any one of items (1) to (17), wherein the light-transmitting component includes a first buckle located at the center of the light-transmitting component, and the base includes a second buckle located at the center of the base, and the first buckle and the second buckle are connected with each other.

(19) The lighting module according to any one of items (1) to (18), further including a heat sink arranged at a side of the bottom plate away from the light-transmitting component.

(20) The lighting module according to any one of items (1) to (19), wherein, in a natural state, a size of an inner circumference of the sealing ring is smaller than a size of an outer circumference of the light-transmitting component.

(21) The lighting module according to any one of items (1) to (20), wherein the light-transmitting component, the base and the accommodating space are provided with no screws.

(22) A lighting device, including the lighting module according to any one of items (1) to (21).

(23) An assembly method of a lighting module according to any one of items (1) to (21), including: sleeving an outer side of the light-transmitting component sidewall with the sealing ring; positioning the base and the light-transmitting component; and applying a force, towards the base, to the light-transmitting component to allow the sealing ring to be arranged between the light-transmitting component sidewall and the base sidewall to seal an interval between the light-transmitting component sidewall and the base sidewall.

(24) The assembly method according to item (23), in the case where the lens sidewall includes a fourth sidewall located at a side of the first sidewall away from the second sidewall, and the base sidewall includes a fifth sidewall, the fourth sidewall and the fifth sidewall are oppositely arranged with a fourth interval therebetween, the fourth interval is larger than the first interval, and the fourth interval is communicated with the first interval and the second interval, the assembly method further includes: disposing a sealant at the fourth interval to seal the first interval and the second interval.

(25) A lighting module, including: a base including a bottom plate and a base sidewall arranged on the bottom plate, the base sidewall and the bottom plate enclose an accommodating groove; a light-transmitting component, at least partially arranged in the accommodating groove to form an accommodating space between the light-transmitting component and the bottom plate, the light-transmitting component includes a light-transmitting component sidewall, and the light-transmitting component sidewall and the base sidewall are oppositely arranged at an interval; and a circuit board, arranged in the accommodating space, and at least a part of the light-transmitting component abuts against a surface of the circuit board away from the bottom plate so as to fix the circuit board in a direction perpendicular to the bottom plate.

(26) The lighting module according to item (25), wherein the circuit board includes a first positioning structure and the base includes a second positioning structure, and the first positioning structure and the second positioning structure cooperate with each other to fix the circuit board in a direction parallel to the bottom plate.

(27) The lighting module according to item (25), further including at least one light emitting element arranged on the circuit board and configured to emit light toward the light-transmitting component, the light-transmitting component includes at least one lens portion, and the at least one lens portion is arranged in one-to-one correspondence with the at least one light emitting element.

(28) The lighting module according to item (27), wherein the light-transmitting component includes a plurality of lens portions arranged in an array, and a portion abutting against the circuit board is arranged around at least one of the plurality of lens portions.

(29) The lighting module according to item (28), wherein the portion abutting against the circuit board is provided around each of the plurality of lens portions.

(30) The lighting module according to any one of items (25) to (29), wherein a portion of the light-transmitting component abutting against the circuit board is in direct contact with the circuit board.

(31) The lighting module according to any one of items (25) to (29), wherein the accommodation space is provided with no screws therein.

Figure 19:
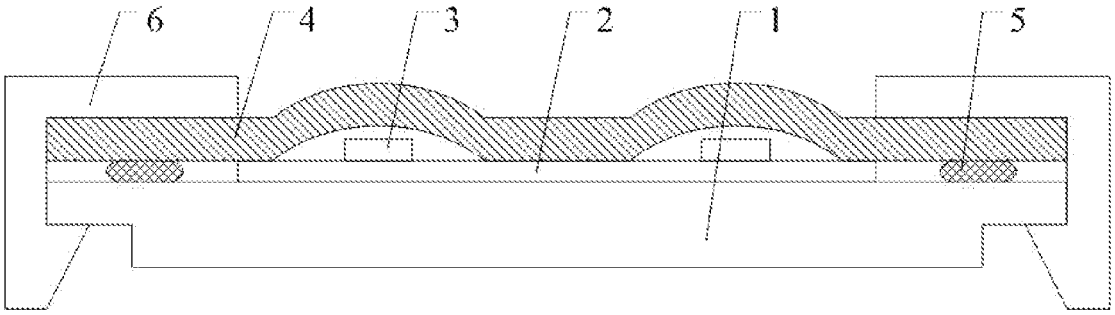
FIG. 19 is a schematic structural diagram of a lighting module.

FIG. 19 is a structural diagram of a lighting module. As illustrated by FIG. 19, the lighting module 10 includes a base 1, a circuit board 2, a light emitting element 3, a lens component 4 and a sealing member 5. The base 1 and the lens component 4 are oppositely arranged to form an accommodating space between the base 1 and the lens component 4, and the circuit board 2 and the light emitting element 3 are located in the accommodating space; the sealing member 5 is located at edges of the lens component 4 and the base 1, and located between the lens component 4 and the base 1. In order to seal the accommodation space, the lighting module 10 also needs to be provided with a pressing device 6 at the edge of the lens component 4 to fasten the lens component 4 and the base 1, so that the sealing member 5 is deformed under pressure. Therefore, the deformed sealing member can seal the accommodating space. However, in the lighting module shown in FIG. 19, an edge part of the lens component will be occupied by a screw, a buckle or a frame, which is not conducive to arranging more light emitting elements (e.g., lamp beads) on the circuit board, and it is difficult to improve the brightness and luminous efficiency of the lighting module. In addition, because there is no protective structure on the lens component, the lighting module is easy to be scratched, resulting in the decline of lighting effect. In this regard, a light-transmitting plate can be arranged on a side of the lens component away from the base, so as to protect the lens component. However, the lighting module with a light-transmitting plate needs to fix the light-transmitting plate by a pressing frame or a pressing sheet. In the case where a pressing sheet is adopted, a plurality of pressing sheets are arranged at intervals along the edge of the light-transmitting plate, and the scattered pressing sheets cause uneven pressure on the light-transmitting plate, which leads to poor waterproof effect. In the case where a pressing frame is adopted, the area occupied by the pressing frame is relatively large, which will block the light emitted by the light emitting elements, resulting in a low light emitting angle of the lighting module.

In this regard, embodiments of the present disclosure provide a lighting module and a lighting device. The lighting module includes a base, a light-transmitting plate, at least one light source component and a sealing component; the base includes a bottom plate and a base sidewall, and the base sidewall is arranged along an edge of the bottom plate to form an accommodating groove; the light-transmitting plate is at least partially located in the accommodating groove, and the light-transmitting plate and the bottom plate are oppositely arranged at an interval to form an accommodating space between the bottom plate and the light-transmitting plate. At least one light source component is located in the accommodating space, the light-transmitting plate includes a light-transmitting plate sidewall, and the light-transmitting plate sidewall and the base sidewall are oppositely arranged at an interval. The sealing component is at least partially located between the light-transmitting plate sidewall and the base sidewall, and is in close contact with the light-transmitting plate sidewall and the base sidewall, respectively, so as to seal the accommodating space. The lighting module can seal the accommodation space by the base sidewall, the light-transmitting plate sidewall and the sealing component, without arranging a pressing sheet, a pressing frame, a buckle, or a screw on the edge of the light-transmitting plate. Thus, under the condition that an outer dimension of the lighting module is unchanged (herein, the outer dimension does not include a structure for connecting the lighting module with the outside), the lighting module can increase the area of the accommodation space to set more light emitting elements, thereby improving the utilization rate of the light emitting surface of the lighting module and improving the illumination brightness and luminous efficiency under the condition that the power of the lighting module is unchanged. In addition, because the lighting module does not need to be provided with a pressing plate, a pressing frame, a buckle or a screw on the edge of the lens component, the light emitting surface of the lighting module will not be shielded, and the light emitting angle of the lighting module will not be affected. It is to be noted that, in the following embodiments, the light-transmitting plate is an implementation of the above-mentioned light-transmitting component.

Figure 20:
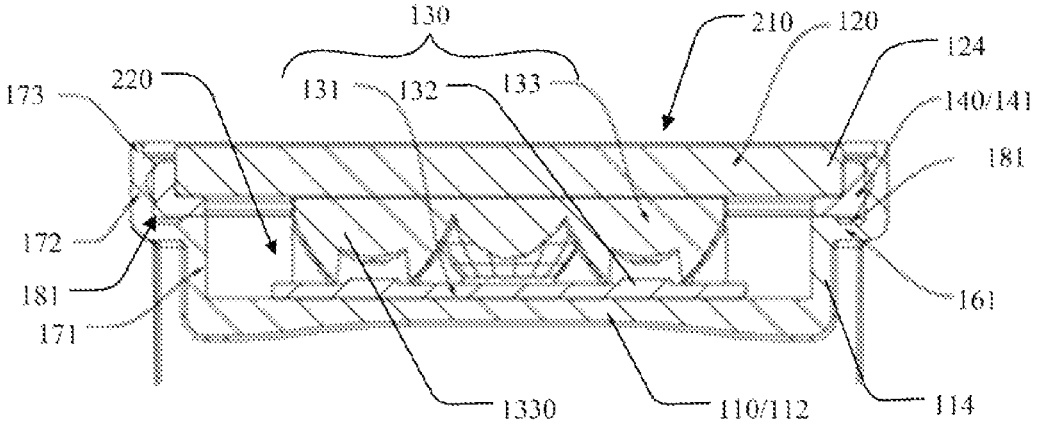
FIG. 20 is a schematic structural diagram of a lighting module according to an embodiment of the present disclosure.

An embodiment of the present disclosure provides a lighting module. FIG. 20 is a schematic structural diagram of a lighting module according to an embodiment of the present disclosure. As illustrated by FIG. 20, the lighting module 100 includes a base 110, a light-transmitting plate 120, at least one light source component 130 and a sealing component 140. The base 110 includes a bottom plate 112 and a base sidewall 114, and the base sidewall 114 is arranged along an edge of the bottom plate 112 to form an accommodating groove 210. The light-transmitting plate 120 is at least partially located in the accommodating groove 210, and the light-transmitting plate 120 and the bottom plate 112 are oppositely arranged at an interval to form an accommodating space 220 between the bottom plate 112 and the light-transmitting plate 120. At least one light source component 130 is located in the accommodating space 220, and each of the at least one light source component 130 includes a lens component 133, which can distribute light for the light source component 130. The light-transmitting plate 120 further includes a light-transmitting plate sidewall 124, and the light-transmitting plate sidewall 124 and the base sidewall 114 are oppositely arranged at an interval. The sealing component 140 is at least partially located between the light-transmitting plate sidewall 124 and the base sidewall 114, and is in close contact with the light-transmitting plate sidewall 124 and the base sidewall 114, respectively, so as to seal the accommodating space 220.

In the lighting module provided by the embodiment of the present disclosure, a light emitting element can be arranged in the accommodation space and used for emitting light, and sealing the accommodation space can prevent external water and oxygen from corroding the light emitting element, thereby prolonging the service life of the lighting module. Because the sealing component is at least partially located between the light-transmitting plate sidewall and the base sidewall, and is in close contact with the light-transmitting plate sidewall and the base sidewall, respectively, the lighting module can seal the accommodation space only by the sealing component, the light-transmitting plate sidewall and the base sidewall, that is, a lateral sealing mode is provided, without setting additional fixing structures such as a pressing frame, a buckle or a screw on the edge of the light-transmitting plate, and without setting additional sealing structures in the accommodation space. Under the condition that an outer dimension of the lighting module is unchanged, the lighting module can increase the area of the accommodation space to set more light emitting elements (such as light emitting diode lamp beads), thereby improving the utilization rate of the light emitting surface of the lighting module and improving the illumination brightness and luminous efficiency under the condition that the power of the lighting module is unchanged.

On the other hand, because the lighting module does not need to be provided with a pressing sheet, a pressing frame, a buckle or a screw on the edge of the light-transmitting plate, the sealing mode of the lighting module will not shield the light emitting surface of the light-transmitting plate and will not affect the light emitting angle of the lighting module. Therefore, the lighting module also has a larger light emitting angle and a better lighting effect. In addition, because the lighting module is provided with the light-transmitting plate outside the light source component, the light-transmitting plate can be made of a hard material such as toughened glass, which can play a better role in protecting the lighting module, and can also play a role in self-cleaning and oil pollution prevention.

In addition, because the lighting module does not need to be provided with a pressing plate, a pressing frame, a buckle or a screw on the edge of the lens component, and does not need to be provided with a sealing component on the edge of the lens component, the lens component can be free from pressure, thereby avoiding deformation of the lens component caused by pressure. Therefore, the lighting module can keep consistent light distribution effect in the long-term use, and has high stability and durability.

In some examples, as illustrated by FIG. 20, each light source component 130 includes a circuit board 131, at least one light emitting element 132 and a lens component 133; the at least one light emitting element 132 is located at a side of the circuit board 131 close to the light-transmitting plate 120. The lens component 133 is located between the at least one light emitting element 132 and the light-transmitting plate 120. The circuit board 131 is electrically connected with the at least one light emitting element 132 and configured to drive the at least one light emitting element 132 to emit light. The lens component 133 includes at least one lens portion 1330 which is arranged in one-to-one correspondence with the at least one light emitting element 132 to distribute light for the at least one light emitting element 132 respectively, thereby improving the light emitting effect of the lighting module. In some examples, the light-transmitting plate has a hardness greater than that of the lens component.

For example, as illustrated by FIG. 20, the lighting module 100 includes one light source component 130. However, embodiments of the present disclosure include but are not limited thereto, and the lighting module may include a plurality of light source components arranged side by side; and the number of light source components can be designed according to actual requirements.

For example, as illustrated by FIG. 20, each light source component 130 includes a plurality of light emitting elements 132. However, the embodiments of the present disclosure include but are not limited thereto, and each light source component may only include one light emitting element 132. Similarly, the number of light emitting elements can be designed according to actual requirements.

For example, the light emitting element can be a light emitting diode (LED). Therefore, the lighting module has the advantages of high luminous efficiency, energy saving and environmental protection.

In some examples, the circuit board and the bottom plate may be integrated into a whole. That is to say, a circuit structure on the circuit board can be directly manufactured on the bottom plate, thereby reducing the thickness of the lighting module.

In some examples, the material of the light-transmitting plate may be a hard transparent material, such as toughened glass. Therefore, the light-transmitting plate has high light transmittance, and meanwhile can play a role in protecting the light source component below, thus avoiding the lens component from being scratched. Moreover, toughened glass can also prevent dust and oil pollution. Of course, the material of the light-transmitting plate is not limited to toughened glass, and other hard transparent materials can also be used as the material of the light-transmitting plate.

In some examples, as illustrated by FIG. 20, the base sidewall 114 includes a sixth sidewall 171, a seventh sidewall 172 and a first platform 161; the sixth sidewall 171 is arranged opposite to an edge of the light source component 130 in a direction parallel to the bottom plate 112; the seventh sidewall 172 is arranged opposite to the light-transmitting plate sidewall 124, and the seventh sidewall 172 is located at a side of the sixth sidewall 171 away from the center of the bottom plate 112. The first platform 161 is connected with the sixth sidewall 171 and the seventh sidewall 172 respectively, and an orthographic projection of the light-transmitting plate 120 on a plane where the bottom plate 112 is located is overlaps with an orthographic projection of the first platform 161 on the plane where the bottom plate 110 is located. Therefore, the light-transmitting plate 120 can be placed on the first platform 161, thereby forming the accommodation space 220 with the bottom plate 112.

In some examples, as illustrated by FIG. 20, the sealing component 140 may include a sealing ring 141, which is at least partially located between the light-transmitting plate sidewall 124 and the seventh sidewall 172 and in close contact with the light-transmitting plate sidewall 124 and the seventh sidewall 172, respectively, and the light-transmitting plate sidewall 124 is configured to apply a force, towards the seventh sidewall 172, to the sealing ring 141 so that the sealing ring 141 is in a compressed state. Therefore, the sealing ring in a compressed state can seal the accommodating space. In addition, compared with the situation that the sealing ring is compressed by the force perpendicular to the bottom plate, in the case where the sealing ring is compressed by the force perpendicular to the light-transmitting plate sidewall, a size of the sealing ring in the direction perpendicular to the light-transmitting plate sidewall is smaller, so that the utilization rate of the light emitting surface of the lighting module can be further improved, and the illumination brightness and luminous efficiency can be improved under the condition that the power of the lighting module is unchanged.

Figure 21:
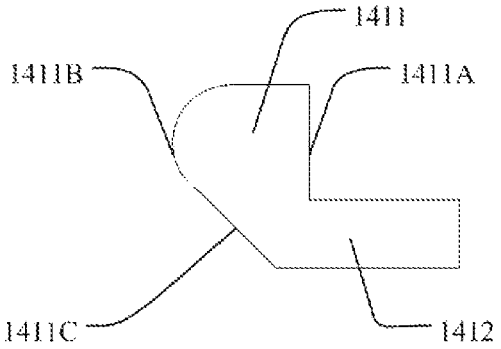
FIG. 21 is a schematic cross-sectional view of a sealing ring according to an embodiment of the present disclosure.

FIG. 21 is a schematic cross-sectional diagram of a sealing ring according to an embodiment of the present disclosure; FIG. 21 is an enlarged schematic diagram of the sealing ring shown in FIG. 20. As illustrated by FIGS. 2 and 3, the sealing ring 141 includes a first sealing portion 1411, which is located between the light-transmitting plate sidewall 124 and the seventh sidewall 172. Upon the sealing ring 141 being in an uncompressed state, the first sealing portion 1411 includes a first flat surface 1411A and a first arc surface 1411B. The first flat surface 1411A is configured to contact the light-transmitting plate sidewall 124. The first arc surface 1411B is arranged opposite to the first flat surface 1411A, and protrudes outwards to be in close contact with the seventh sidewall 172 and in a compressed state to from a contact surface. It should be noted that the above-mentioned first flat surface refers to a flat surface at least in the direction perpendicular to the bottom plate. In the case where the shape of the orthographic projection of the sealing ring on the bottom plate is a rounded polygonal ring (for example, a rounded rectangular ring), the contact surface between the first sealing portion and the seventh sidewall at the rounded corner can be changed correspondingly according to the shape of the seventh sidewall. For example, in the case where the seventh sidewall at the rounded corner is curved, the surface of the first sealing portion contacting the seventh sidewall may also be an arc surface.

In the lighting module according to the present example, the first flat surface is used to contact with the light-transmitting plate sidewall, so that the sealing ring can have better contact with the light-transmitting plate sidewall, and the sealing ring can be stably sleeved on the light-transmitting plate sidewall to avoid the sealing ring from twisting. The first arc surface is arranged opposite to the first flat surface and used for contacting with the base sidewall, and the first arc surface has a certain guiding function, so that the sealing ring can be extruded onto the base sidewall more smoothly.

In some examples, as illustrated by FIGS. 2 and 3, upon the sealing ring being in an uncompressed state, the first sealing portion 1411 further includes a first inclined surface 1411C connected with the first arc surface 1411B and located at a side of the first arc surface 1411B close to the base 112, and the first inclined surface 1411C and the seventh sidewall 172 are oppositely arranged at an interval to form a first deformation space. Therefore, the first deformation space can be used to accommodate the deformation of the compressed sealing ring, so that the sealing ring can be prevented from jumping out due to the compression deformation. On the other hand, a plane where the first inclined surface is located and a plane where the first flat surface is located form an acute angle close to the sixth sidewall, which has a certain guiding effect, thus facilitating installation.

In some examples, as illustrated by FIGS. 2 and 3, the sealing ring 141 further includes a second sealing portion 1412, which is arranged between the light-transmitting plate 120 and the first platform 161 and connected with the first sealing portion 1411. The first sealing portion 1411 and the second sealing portion 1412 are of an integrated structure, and the sealing ring 141 can be better wrapped on the light-transmitting plate 120 by the second sealing portion 1412, and the sealing ring 1411 can be prevented from twisting upon the light-transmitting plate 120 and the sealing ring 141 are pressed down to the base 110. Of course, the embodiment of the present disclosure includes but is not limited thereto, and the sealing ring may only include the first sealing portion described above, and the cross-sectional shape of the first sealing portion is not limited to the shape shown in FIG. 21, but may also be a round shape, a square shape, etc.

In some examples, as illustrated by FIG. 20, the side of the first platform 161 close to the second sealing portion 1412 includes a first recessed portion 181, and the first recessed portion 181 forms a second deformation space. Therefore, the second deformation space can reserve space for the deformation of the sealing ring and prevent the sealing ring from jumping out due to compression deformation.

Figure 22:
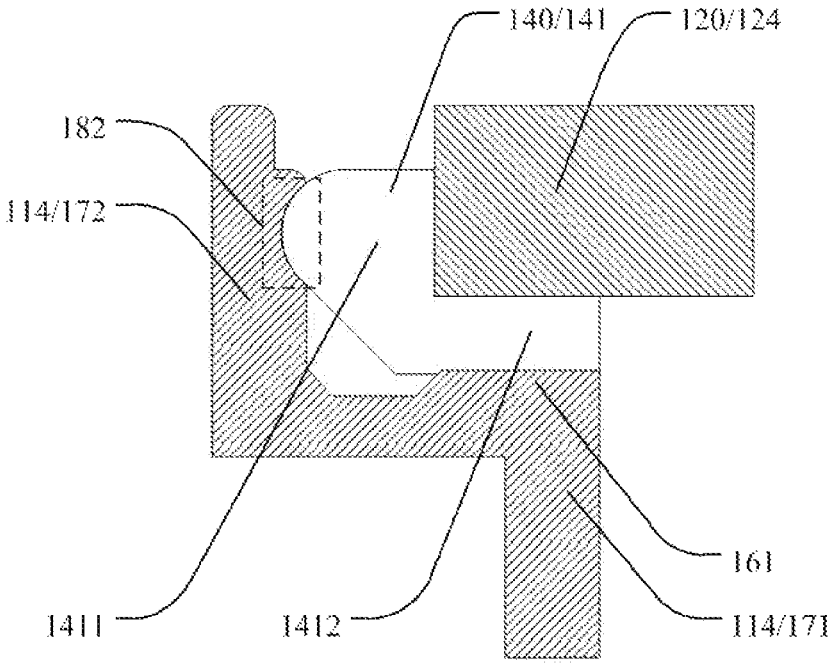
FIG. 22 is a schematic structural diagram of another lighting module provided by an embodiment of the present disclosure.

FIG. 22 is a schematic structural diagram of another lighting module according to an embodiment of the present disclosure. As illustrated by FIG. 22, the base sidewall 114 includes a second recessed portion 182, which is recessed from the surface of the base sidewall 114 close to the light-transmitting plate 120 and can accommodate a part of the sealing component 140. Therefore, the second recessed portion 182 can limit the sealing component 140 and enhance the sealing and waterproof performance.

For example, as illustrated by FIG. 22, in the case where the base sidewall 114 includes a sixth sidewall 171 and a seventh sidewall 172, and the sealing component 140 is a sealing ring 141, the seventh sidewall 172 includes the above-mentioned second recessed portion 182, which is recessed from the surface of the base sidewall 114 close to the light-transmitting plate 120 and can accommodate a part of the sealing ring 141.

Figure 23:
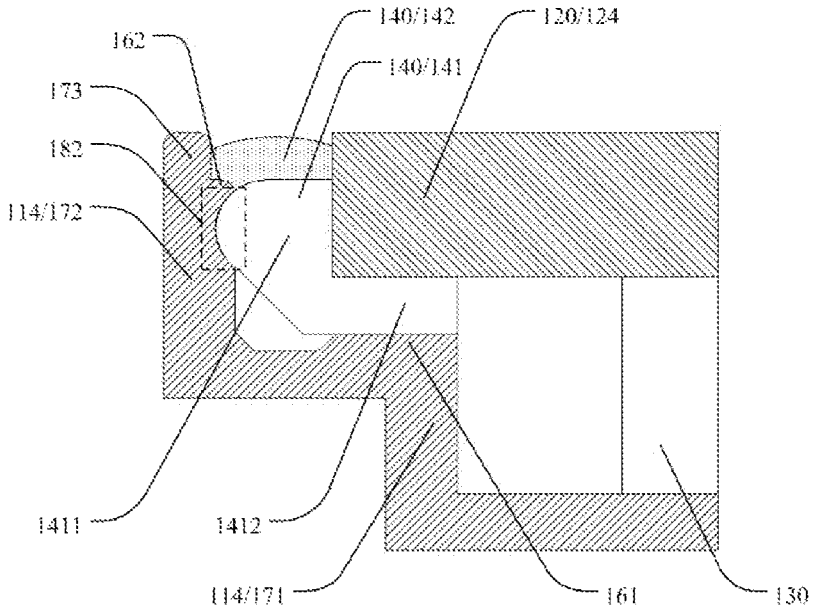
FIG. 23 is a schematic structural diagram of another lighting module provided by an embodiment of the present disclosure.

FIG. 23 is a schematic structural diagram of another lighting module according to an embodiment of the present disclosure. As illustrated by FIG. 23, the base sidewall 114 further includes an eighth sidewall 173 and a second platform 162; the eighth sidewall 173 is arranged opposite to the light-transmitting plate sidewall 124 with a first interval therebetween, and the eighth sidewall 173 is located at a side of the seventh sidewall 172 away from the bottom plate 112; the second platform 162 is connected with the seventh sidewall 172 and the eighth sidewall 173, respectively. The seventh sidewall 172 is arranged opposite to the light-transmitting plate sidewall 124 with a second interval, and the width of the first interval is greater than that of the second interval. In this case, as illustrated by FIG. 23, the sealing component 140 further includes a sealant 142, which is at least partially located in the first interval, and the sealant 142 is in close contact with the eighth sidewall 173 and the light-transmitting plate sidewall 124, respectively. That is to say, the sealing component 140 can include a sealing ring 141 and a sealant 142 at the same time, and the sealing ring 141 is at least partially located between the light-transmitting plate sidewall 124 and the seventh sidewall 172 and in close contact with the light-transmitting plate sidewall 124 and the seventh sidewall 172, respectively; and the sealant 142 is located at a side of the sealing ring 141 away from the first platform 161, and at least a part of the sealant 142 is located in the first interval, and is in close contact with the eighth sidewall 173 and the light-transmitting plate sidewall 124 respectively, thereby further enhancing the sealing and waterproof performance of the lighting module. In addition, because the width of the first interval is set larger than that of the second interval, it is more convenient to carry out the processes such as a process of applying the sealant.

In some examples, as illustrated by FIG. 23, the sixth sidewall 171 and an edge of the light source component 130 have a third interval, and the width of the third interval is larger than that of the first interval. Therefore, the light source component 130 has a certain distance from the base sidewall 114, which can prevent the base sidewall 114 from shielding the light emitted by the light source component 130, so that the lighting module has a larger light emitting angle. Of course, the embodiments of the present disclosure include but are not limited thereto, and the width of the third interval can also be smaller than or equal to the width of the first interval, so that more light source components or larger light source components can be arranged in the accommodation space, thereby improving the illumination brightness and luminous efficiency.

It should be noted that, FIG. 22 shows the case where the sealing component only includes a sealing ring; FIG. 23 shows the case where the sealing component includes both a sealing ring and a sealant, however, the embodiment of the present disclosure includes but is not limited thereto, and the sealing component may only include the sealant.

Figure 24:
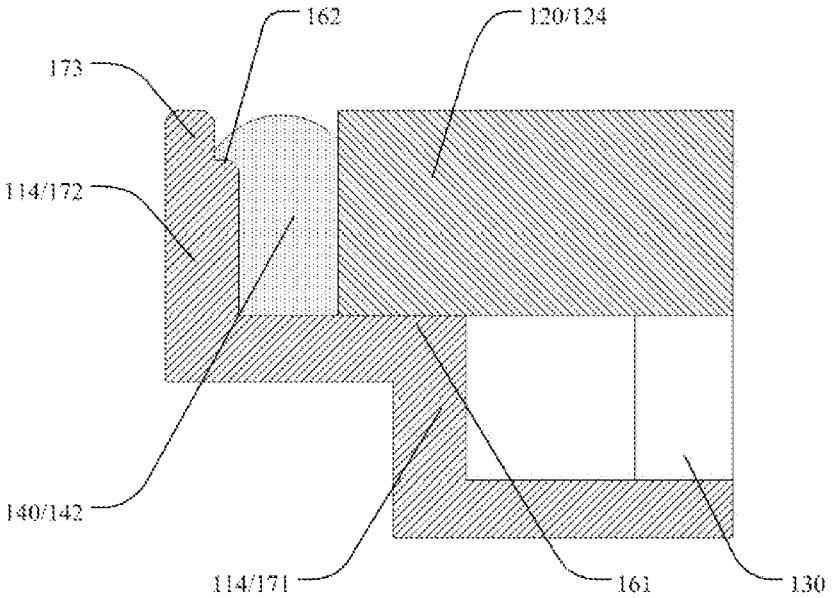
FIG. 24 is a schematic structural diagram of another lighting module provided by an embodiment of the present disclosure.

FIG. 24 is a schematic structural diagram of another lighting module provided by an embodiment of the present disclosure. As illustrated by FIG. 24, the base sidewall 114 includes an eighth sidewall 173 and a second platform 162; the eighth sidewall 173 is arranged opposite to the light-transmitting plate sidewall 124 with a first interval, and the eighth sidewall 173 is located at a side of the seventh sidewall 172 away from the bottom plate 112; the second platform 162 is connected to the seventh sidewall 172 and the eighth sidewall 173, respectively. The sealing component 140 may only include a sealant 142, which is at least partially located in the first interval, and the sealant 142 is in close contact with the eighth sidewall 173 and the light-transmitting plate sidewall 124, respectively, so as to seal the accommodating space 210.

In some examples, as illustrated by FIG. 24, the seventh sidewall 172 and the light-transmitting plate sidewall 124 are oppositely arranged with a second interval therebetween, the width of the second interval is smaller than that of the first interval, and the sealant 142 is also located in the second interval.

In some examples, as illustrated by FIG. 24, the sixth sidewall 171 and the edge of the light source component 130 have a third interval therebetween, and the width of the third interval is larger than that of the first interval. Similarly, the light source component 130 has a certain distance from the base sidewall 114, which can prevent the base sidewall 114 from shielding the light emitted by the light source component 130, so that the lighting module has a larger lighting angle. Of course, the embodiments of the present disclosure include but are not limited thereto, and the width of the third interval can also be smaller than or equal to the width of the first interval, so that more light source components or larger light source components are arranged in the accommodation space, thereby improving the illumination brightness and luminous efficiency.

Figure 25:
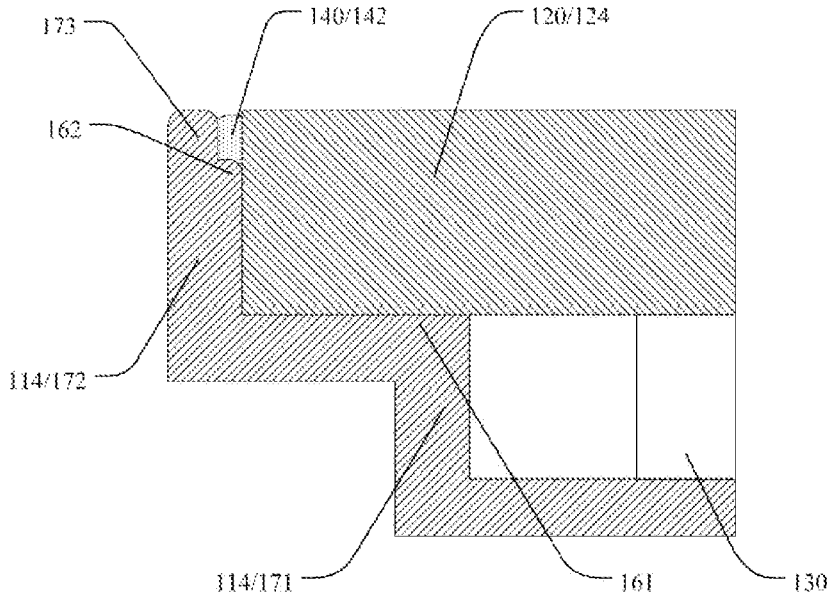
FIG. 25 is a schematic structural diagram of another lighting module provided by an embodiment of the present disclosure.

FIG. 25 is a schematic structural diagram of another lighting module provided by an embodiment of the present disclosure. As illustrated by FIG. 25, the seventh sidewall 172 is in contact with the light-transmitting plate sidewall 124, that is, the second interval is zero. As illustrated by FIG. 25, the sealant 142 is located in the first interval, and the sealant 142 is in close contact with the eighth sidewall 173 and the light-transmitting plate sidewall 124, respectively, to seal the accommodating space 210. Therefore, in the case where the sealant is used for sealing, the seventh sidewall and the light-transmitting plate sidewall are in contact with each other, so that the seventh sidewall and the light-transmitting plate sidewall can have certain sealing and waterproof effects.

Figure 26:
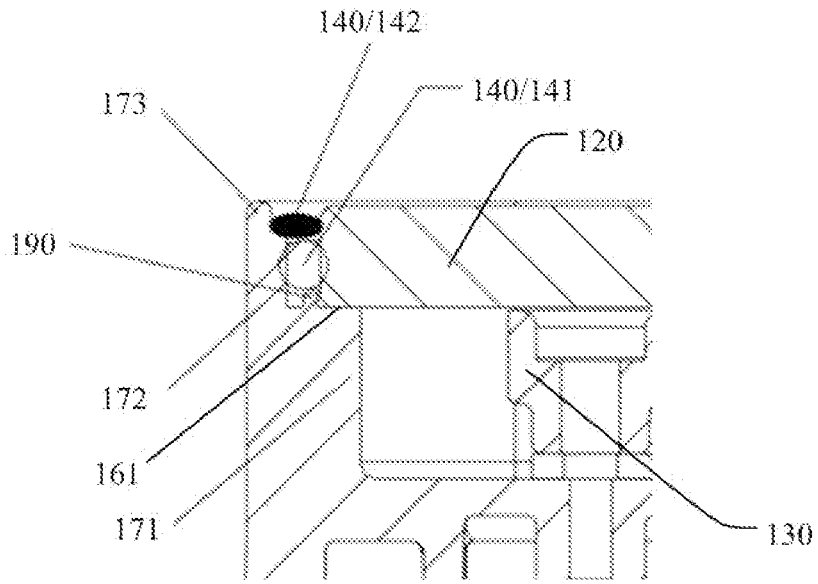
FIG. 26 is a schematic structural diagram of another lighting module provided by an embodiment of the present disclosure.

FIG. 26 is a schematic structural diagram of another lighting module provided by an embodiment of the present disclosure. As illustrated by FIG. 26, the first platform 161 includes a protrusion 190, and the light-transmitting plate 120 is located at a side of the protrusion 190 away from the seventh sidewall 172, that is, the light-transmitting plate 120 is located at an inner side of the protrusion 190. In this case, the protrusion 190 can position or limit the light-transmitting plate 120. On the one hand, the protrusion is beneficial to the installation of the light-transmitting plate; on the other hand, the protrusion can prevent the light-transmitting plate from sliding.

In some examples, as illustrated by FIG. 26, the light-transmitting plate sidewall 124 is in contact with the protrusion 190. Therefore, the protrusion 190 can also play a sealing role to further improve the sealing performance and waterproof performance of the lighting module.

In some examples, in the lighting module shown in FIG. 26, the light-transmitting plate 120 may be placed on the first platform, so the sealing ring 141 may only include the first sealing portion described above, and not include the second sealing portion located between the light-transmitting plate and the first platform. For example, as illustrated by FIG. 26, the cross section of the sealing ring 141 is circular, and the sealing ring 141 is totally located between the light-transmitting plate sidewall 124 and the seventh sidewall 172.

Figure 27:
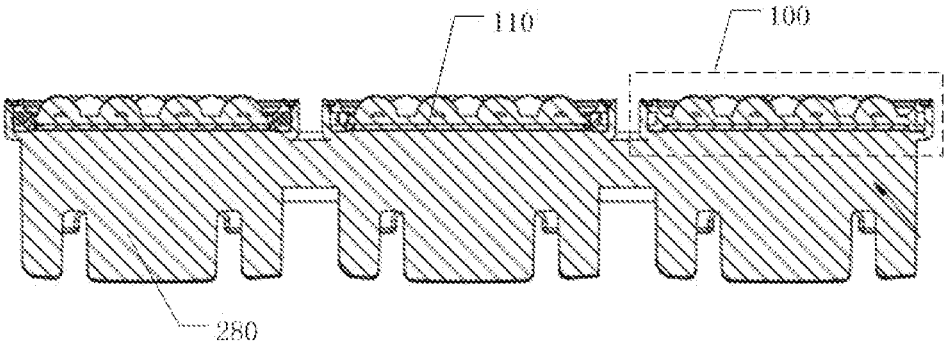
FIG. 27 is a schematic structural diagram of a lighting device according to an embodiment of the present disclosure.

An embodiment of the present disclosure also provides a lighting device. FIG. 27 is a structural schematic diagram of a lighting device according to an embodiment of the present disclosure. As illustrated by FIG. 27, the lighting device 200 includes the lighting module 100 as described above. Therefore, the lighting device also has the beneficial effects corresponding to the beneficial effects of the lighting module, and the repeated portions are omitted herein. For details, please refer to the related description of the lighting module.

In some examples, the lighting device can be a street lamp, a stadium lamp, an airport lamp and the like.

In some examples, as illustrated by FIG. 27, the lighting device 200 includes a plurality of lighting modules 100 and a heat sink 280; bases 110 of the plurality of lighting modules 100 are fixed on the heat sink 280 to collectively dissipate heat through the heat sink 280.

The following points should be noted:

(1) Those not involved in the embodiment of the present disclosure refer to the conventional design.

(2) For clarity, the thickness of layers or areas in the accompanying drawings of the embodiments of the present disclosure is enlarged. It should be understood that when an element such as a layer, a film, an area or a circuit board is referred to be disposed "on" or "beneath" another element, the element may be "directly" disposed "on" or "beneath" another element, or an intermediate element may be provided.

(3) The embodiments of the present invention and the characteristics in the embodiments may be mutually combined without conflict.

The above is only the specific embodiment of the disclosure, but the protection scope of this disclosure is not limited to this. Any those skilled in the art can easily think of changes or substitutions within the technical scope disclosed in this disclosure, which should be covered within the protection scope of this disclosure. Therefore, the protection scope of this disclosure shall be subject to the protection scope of the claims.

What is claimed is:

1. A lighting module, comprising:

a base, comprising a bottom plate and a base sidewall arranged on the bottom plate, the base sidewall and the bottom plate enclosing an accommodating groove;

a light-transmitting component, at least partially arranged in the accommodating groove to form an accommodating space between the light-transmitting component and the bottom plate, the light-transmitting component comprising a light-transmitting component sidewall, and the light-transmitting component sidewall and the base sidewall being oppositely arranged at an interval; and a sealing component, at least partially arranged between the light-transmitting component sidewall and the base sidewall, and being in close contact with the light-transmitting component sidewall and the base sidewall, respectively, so as to seal the accommodating space, the light-transmitting component sidewall comprises:

a first sidewall, oppositely arranged at an interval with the base sidewall and having a first interval with the base sidewall; and a second sidewall, oppositely arranged at an interval with the base sidewall and having a second interval with the base sidewall, wherein the first sidewall is located at a side of the second sidewall away from the base, the second interval is larger than the first interval, and the sealing component is at least partially arranged between the second sidewall and the base sidewall, and is in close contact with the second sidewall and the base sidewall, respectively.

2. The lighting module according to claim 1, wherein the base comprises two base sidewalls extending along a first direction, the two base sidewalls are oppositely arranged and form the accommodating groove with the bottom plate, the sealing component is a sealing strip which is at least partially arranged between the light-transmitting component sidewall and the base sidewall which are correspondingly arranged, and the sealing strip is in close contact with the light-transmitting component sidewall and the base sidewall, respectively.

3. The lighting module according to claim 2, further comprising:

a sealing structure, located between the light-transmitting component and the bottom plate and at least located at two ends of the two base sidewalls in the first direction, wherein the sealing structure and the sealing strip collectively seal the accommodating space.

4. The lighting module according to claim 1, further comprising:

a sealant, at least a part of which is located at an end of an interval between the light-transmitting component sidewall and the base sidewall, and the end is located at a side of the sealing component away from the bottom plate.

5. The lighting module according to claim 1, wherein the light-transmitting component sidewall is configured to apply a force, towards the base sidewall, to the sealing component, so that the sealing component is in a compressed state.

6. The lighting module according to claim 1, wherein the sealing component comprises a first sealing portion, the first sealing portion is arranged between the light-transmitting component sidewall and the base sidewall, and the first sealing portion upon being in an uncompressed state, comprises:

a first flat surface, configured to contact the second sidewall;

a first arc surface, arranged opposite to the first flat surface, protruding outward and configured to contact with the base sidewall; and a first inclined surface, connected with the first arc surface and located at a side of the first arc surface close to the base, wherein the first inclined surface is configured to be spaced apart from the base sidewall to form a deformation space, the first arc surface is compressed to closely contact the base sidewall along a contact surface; the first inclined surface is located between the first sidewall and the bottom plate; and an orthographic projection of the first inclined surface on the bottom plate at least partially overlaps with an orthographic projection of the second interval on the bottom plate.

7. The lighting module according to claim 6, wherein the sealing component further comprises a second sealing portion, the second sealing portion is arranged between the light-transmitting component and the bottom plate and connected with the first sealing portion.

8. The lighting module according to claim 6, further comprising:

a circuit board, located in the accommodating space; and at least one light emitting element, arranged on the circuit board and configured to emit light towards the light-transmitting component, wherein the light-transmitting component comprises at least one lens portion, and the at least one lens portion is arranged in one-to-one correspondence with the at least one light emitting element.

9. The lighting module according to claim 8, wherein an interval is provided between an edge of the circuit board close to the base sidewall and the base sidewall, and the second sealing portion is arranged between the edge of the circuit board close to the base sidewall and the base sidewall.

10. A lighting module, comprising:

a base, comprising a bottom plate and a base sidewall arranged on the bottom plate, the base sidewall and the bottom plate enclosing an accommodating groove;

a light-transmitting component, at least partially arranged in the accommodating groove to form an accommodating space between the light-transmitting component and the bottom plate, the light-transmitting component comprising a light-transmitting component sidewall, and the light-transmitting component sidewall and the base sidewall being oppositely arranged at an interval; and a sealing component, at least partially arranged between the light-transmitting component sidewall and the base sidewall, and being in close contact with the light-transmitting component sidewall and the base sidewall, respectively, so as to seal the accommodating space, wherein the light-transmitting module is a light-transmitting plate, the light-transmitting plate comprises a light-transmitting sidewall, the light-transmitting sidewall and the base sidewall are oppositely arranged at an interval, the lighting module further comprises:

at least one light source component, located in the accommodating space, each of the at least one light source component comprising a lens component configured to distribute light for the each of the at least one light source component, the light-transmitting plate is located at a side of the lens component away from the base, the base sidewall comprises:

a sixth sidewall, arranged opposite to an edge of the light source component in a direction parallel to the bottom plate;

a seventh sidewall, arranged opposite to the light-transmitting plate sidewall, the seventh sidewall is located at a side of the sixth sidewall away from the bottom plate and a side of the sixth sidewall away from a center of the bottom plate; and a first platform, respectively connected with the sixth sidewall and the seventh sidewall, wherein an orthographic projection of the light-transmitting plate on a plane where the bottom plate is located overlaps with an orthographic projection of the first platform on the plane where the bottom plate is located.

11. The lighting module according to claim 10, wherein the first platform comprises a protrusion, the light-transmitting plate is located at a side of the protrusion away from the second sidewall, the protrusion is configured to position the light-transmitting plate, the light-transmitting plate sidewall is in contact with the protrusion.

12. The lighting module according to claim 10, wherein the base sidewall comprises a recessed portion, which is recessed from a surface of the base sidewall close to the light-transmitting plate and configured to accommodate a part of the sealing component.

13. A lighting device, comprising:

the lighting module; and a heat sink, configured to dissipate heat for the lighting module, wherein the lighting module comprises:

a base, comprising a bottom plate and a base sidewall arranged on the bottom plate, the base sidewall and the bottom plate enclosing an accommodating groove;

a light-transmitting component, at least partially arranged in the accommodating groove to form an accommodating space between the light-transmitting component and the bottom plate, the light-transmitting component comprising a light-transmitting component sidewall, and the light-transmitting component sidewall and the base sidewall being oppositely arranged at an interval; and a sealing component, at least partially arranged between the light-transmitting component sidewall and the base sidewall, and being in close contact with the light-transmitting component sidewall and the base sidewall, respectively, so as to seal the accommodating space the heat sink comprises: a heat sink plate, comprising a plurality of sub heat sink plates, the lighting device comprises a plurality of lighting modules, and the lighting modules are arranged in one-to-one correspondence with the plurality of sub heat sink plates, and the base of each of the plurality of lighting modules is fixed on a corresponding one of the plurality of sub heat sink plates.

14. The lighting device according to claim 13, wherein the lighting device comprises a plurality of lighting modules, bases of the lighting modules are spliced as a whole, and base sidewalls of the plurality of lighting modules are arranged at intervals.

15. The lighting device according to claim 13, wherein a plurality of heat sink fins are provided on a side of each of the plurality of sub heat sink plates away from the light-transmitting component.

16. The lighting device according to claim 13, wherein two adjacent ones of the plurality of sub heat sink plates are arranged at an interval, and are connected through the plurality of heat sink fins.

17. The lighting device according to claim 13, wherein each of the plurality of sub heat sink plates is provided with a wire passing hole, a sealing plug is arranged in the wire passing hole, the sealing plug passes through the wire passing hole and includes a through hole allowing a wire to pass through, a communication groove is provided on a side of the heat sink plate away from the light-transmitting component, the communication groove connects a plurality of wire passing holes of the plurality of sub heat sink plates.

* * * * *